US011358213B2

(12) United States Patent
Harada et al.

(10) Patent No.: US 11,358,213 B2
(45) Date of Patent: Jun. 14, 2022

(54) DEVICE FOR CONTROLLING FLOW IN MOLD AND METHOD FOR CONTROLLING FLOW IN MOLD IN THIN-SLAB CASTING

(71) Applicant: NIPPON STEEL CORPORATION, Tokyo (JP)

(72) Inventors: Hiroshi Harada, Tokyo (JP); Keita Ikeda, Tokyo (JP); Masashi Sakamoto, Tokyo (JP); Yui Ito, Tokyo (JP); Takuya Takayama, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/059,686

(22) PCT Filed: Jun. 7, 2019

(86) PCT No.: PCT/JP2019/022726
§ 371 (c)(1),
(2) Date: Nov. 30, 2020

(87) PCT Pub. No.: WO2019/235613
PCT Pub. Date: Dec. 12, 2019

(65) Prior Publication Data

US 2021/0205877 A1 Jul. 8, 2021

(30) Foreign Application Priority Data

Jun. 7, 2018 (JP) ..... JP2018-109150
Nov. 9, 2018 (JP) ..... JP2018-211091

(51) Int. Cl.
*B22D 11/115* (2006.01)
*B22D 11/103* (2006.01)
*B22D 11/041* (2006.01)

(52) U.S. Cl.
CPC ..... *B22D 11/115* (2013.01); *B22D 11/103* (2013.01); *B22D 11/041* (2013.01)

(58) Field of Classification Search
CPC ... B22D 11/115; B22D 11/103; B22D 11/041; B22D 11/0642
See application file for complete search history.

(56) References Cited

U.S. PATENT DOCUMENTS 6,152,336 A 11/2000 Arvedi et al.
9,352,386 B2 5/2016 Guastini et al.
2011/0209847 A1* 9/2011 Toh ..... B22D 11/115 164/504

FOREIGN PATENT DOCUMENTS

JP 2001-047196 A 2/2001
JP 2001-205396 A 7/2001
(Continued)

OTHER PUBLICATIONS

"Ironmaking and steelmaking", Iron and Steel Handbook, 5th Edition, vol. 1, pp. 454 to 456, ISBN 978-4-930980-80-9, 2014, Japan.

(Continued)

*Primary Examiner* — Kevin P Kerns
*Assistant Examiner* — Steven S Ha
(74) *Attorney, Agent, or Firm* — Myers Wolin, LLC

(57) ABSTRACT

The device for controlling a flow in a mold in thin-slab casting of steel has a thickness on the short side of the meniscus portion of 150 mm or less and a casting width of 2 m or less and includes a DC magnetic field generation unit and an immersion nozzle having a slit formed at the bottom so that the slit leads to the bottom of the discharge hole and opens outside, the discharge hole and the slit are present in the DC magnetic field zone, and the magnetic flux density B (T) in the DC magnetic field zone and the distance L (m)

(Continued)

from the lower end of the immersion nozzle to the lower end of the core satisfy Formulae (1) and (2) described below:

$$0.35T \leq B \leq 1.0T \quad \text{Formula (1)}$$

$$L \geq 0.06 \text{ m} \quad \text{Formula (2)}$$

10 Claims, 10 Drawing Sheets

(56) References Cited

FOREIGN PATENT DOCUMENTS

| | | | | |
|---|---|---|---|---|
| JP | 2007-105769 | A | 4/2007 | |
| WO | WO-2013069121 | A1 * | 5/2013 | ..... B22D 11/041 |

OTHER PUBLICATIONS

Okano et al., "Relation between Large Inclusions and Growth Directions of Columnar Dendrites in Continuously Cast Slabs", Iron and Steel, vol. 61, p. 2982, 1975, Japan, with English abstract.

* cited by examiner

DEVICE FOR CONTROLLING FLOW IN MOLD AND METHOD FOR CONTROLLING FLOW IN MOLD IN THIN-SLAB CASTING

CROSS-REFERENCE TO RELATED APPLICATION

This application is a national stage application of International Application No. PCT/JP2019/022726, filed on Jun. 7, 2019 and designated the U.S., which claims priority to Japanese Patent Application No. 2018-211091, filed on Nov. 9, 2018 and Japanese Patent Application No. 2018-109150, filed on Jun. 7, 2018. The contents of each are herein incorporated by reference.

TECHNICAL FIELD

The present disclosure relates to a device for controlling a flow in a mold and a method for controlling a flow in a mold in thin-slab casting of steel.

The present application claims priority based on Japanese Patent Application No. 2018-109150 filed in Japan on Jun. 7, 2018 and Japanese Patent Application No. 2018-211091 filed in Japan on Nov. 9, 2018, and the contents thereof are incorporated herein.

RELATED ART

A method for casting a thin slab is known in which a thin slab having a slab thickness of 40 to 150 mm is cast. The cast thin slab is heated and then rolled with a small rolling mill having 4 to 7 stages. As a continuous casting mold used for thin-slab casting, a method in which a funnel-shaped mold (funnel mold) is used and a method in which a rectangular parallel mold is used are employed. The funnel-shaped mold is formed into a funnel shape in which the opening at the lower end of the mold (the part where the molten steel and the solidified shell are filled) is rectangular, the opening at the meniscus portion of the mold has the same width of the short side as the width of the short side of the lower end of the mold, the opening width of the part into which the immersion nozzle is inserted is expanded, and the surface shape of the opening is gradually narrowed below the lower end of the immersion nozzle. In continuous casting of a thin slab, it is necessary to secure productivity by high-speed casting, and the high-speed casting at 5 to 6 m/min industrially and maximum 10 m/min is possible (see Non-Patent Document 1).

In thin-slab casting, the casting thickness is generally as thin as 150 mm or less as described above while the casting width is about 1.5 m, and the aspect ratio is high. Since the casting speed is high-speed casting at 5 m/min, the throughput is also high. In addition, a funnel-shaped mold is often used for facilitating molten steel pouring into the mold, so that the flow in the mold is further complicated. Therefore, it is common to reduce the nozzle discharge flow rate by flattening the nozzle shape and providing the nozzle with a plurality of discharge holes to divide the discharge flow (see Patent Document 1). Furthermore, in order to brake each of the plurality of nozzle discharge flows, a method has been also proposed in which a plurality of electromagnets are arranged on the long side of the mold to brake the flow (see Patent Documents 2 and 3).

The immersion nozzle used for ordinary continuous casting that is not thin-slab casting has a bottomed cylindrical shape and has a discharge hole on each of both the side surfaces of the immersion portion. Meanwhile, a nozzle is known that has a slit that opens downward to the outside at the bottom of the immersion nozzle (see Patent Documents 4 and 5). The slit leads to the bottom of the cylinder and to the bottoms of the left and right discharge holes, and opens. The molten metal flowing out into the mold through the immersion nozzle flows out not only from the left and right discharge holes but also from this slit, so that the flow rate of the molten metal flowing out from the discharge holes can be relatively reduced. However, in the ordinary continuous casting that is not thin-slab casting, an Ar gas is blown into the molten metal passing through the immersion nozzle in order to prevent the immersion nozzle from clogging, and as a result, because bubbles blown downward from the slit along with the nozzle discharge flow directly floats upward, the bubbles boil around the nozzle, and the immersion nozzle cannot be well utilized.

Furthermore, in the ordinary slab continuous casting that is not thin-slab casting, in-mold electromagnetic stirring is used, and a swirling flow is formed in a horizontal cross section. Meanwhile, in thin-slab casting, such in-mold electromagnetic stirring is not used. The reason is considered to be, for example, that it is assumed that a swirling flow is difficult to form because of the thin mold thickness, and that it is considered that a sufficient flow has been already applied in front of the solidified shell by the high-speed casting, and it is unfavorable to further apply a swirling flow in the vicinity of the molten metal surface because of the complication of the flow in the mold.

CITATION LIST

Patent Document

[Patent Document 1]
U.S. Pat. No. 6,152,336
[Patent Document 2]
Japanese Unexamined Patent Application, First Publication No. 2001-47196
[Patent Document 3]
U.S. Pat. No. 9,352,386
[Patent Document 4]
Japanese Unexamined Patent Application, First Publication No. 2001-205396
[Patent Document 5]
Japanese Unexamined Patent Application, First Publication No. 2007-105769

Non-Patent Document

[Non-Patent Document 1]
5th Edition Iron and Steel Handbook Volume 1 Ironmaking and Steelmaking, pages 454-456
[Non-Patent Document 2]
Shinobu Okano et al., "Iron and Steel," 61 (1975), page 2982

SUMMARY

Problems to be Solved

As described above, in thin-slab casting, a method has been proposed in which the nozzle discharge flow rate is reduced by providing the nozzle with a plurality of discharge holes to divide the discharge flow and the flow is braked by arranging a plurality of electromagnets on the long side of the mold. However, it cannot be said that a constant flow pattern is formed in dividing the nozzle discharge flow because the flow is a turbulent flow. Furthermore, when a plurality of electromagnets are provided to form a magnetic field, the magnetic field is decreased at the end of the electromagnet, and the distribution of the magnetic field is nonuniform. The fluid easily slips through the portion where the magnetic field is weak, and as a result, it is difficult to stably decrease the flow distribution. Therefore, it cannot be said that the problem how to form the nozzle discharge flow in thin-slab casting has been solved.

Therefore, an object of the present disclosure is to provide a device for controlling a flow in a mold and a method for controlling a flow in a mold in which a slab excellent in the surface and the inner quality can be cast by stably controlling the flow in the mold and effectively supplying heat to the meniscus in the mold in thin-slab casting of steel.

Means for Solving the Problem

The gist of the present disclosure is as follows.

(1) A first aspect of the present disclosure is a device for controlling a flow in a mold including:

a DC magnetic field generation unit having a core that applies a DC magnetic field toward a mold thickness direction in an entire width in a mold width direction; and an immersion nozzle having a discharge hole formed on each of both side surfaces in the mold width direction, and having a slit formed at a bottom so that the slit leads to a bottom of each discharge hole and opens outside, the device having a thickness on a short side of a meniscus portion of 150 mm or less and a casting width of 2 m or less, the device used in thin-slab casting of steel, wherein the discharge hole and the slit are present in a DC magnetic field zone that is a height region in which the core of the DC magnetic field generation unit is present, and a magnetic flux density B (T) in the DC magnetic field zone and a distance L (m) from a lower end of the immersion nozzle to a lower end of the core satisfy Formulae (1) and (2) described below:

$$0.35T \leq B \leq 1.0T \quad \text{Formula (1)}$$

$$L \geq 0.06 \text{ m} \quad \text{Formula (2).}$$

(2) In the device for controlling a flow in a mold disclosed in (1) above, a discharge hole diameter d (mm) of the discharge hole, the discharge hole diameter corresponding to a diameter of a circle having the same cross-sectional area as a total cross-sectional area of an opening on the side surface of the immersion nozzle, a slit thickness δ (mm) of the slit, and an inner diameter D (mm) of the immersion nozzle may satisfy Formulae (3) and (4) described below:

$$D/8 \leq \delta \leq D/3 \quad \text{Formula (3)}$$

$$\delta \leq d \leq 2/3 \times D \quad \text{Formula (4).}$$

(3) In the device for controlling a flow in a mold disclosed in (1) or (2) above, the discharge hole may be formed so that a discharge flow is perpendicular to an axis direction of the immersion nozzle.

(4) The device for controlling a flow in a mold disclosed in any one of (1) to (3) above may further include an electromagnetic stirring unit that is configured to apply a swirling flow on a surface of molten steel in the mold.

(5) In the device for controlling a flow in a mold disclosed in (4) above, a thickness $D_{Cu}$ (mm) of a copper plate forming a long side wall of the mold, a thickness T (mm) of a slab, a frequency f (Hz) of the electromagnetic stirring unit, and an electric conductivity $\sigma_{Cu}$ (S/m) of the copper plate may be adjusted to satisfy Formulae (7A) and (7B) described below:

$$D_{Cu} < \sqrt{(2/(\sigma_{Cu}\omega\mu))} \quad \text{Formula (7A)}$$

$$\sqrt{(1/(2\sigma\omega\mu))} < T \quad \text{Formula (7B)}$$

wherein ω represents an angular velocity (rad/sec) of 2πf, μ represents a magnetic permeability ($N/A^2$) of a vacuum of $4\pi \times 10^{-7}$, and σ represents an electric conductivity of the molten steel.

(6) A second aspect of the present disclosure is a method for controlling a flow in a mold, the method using the device for controlling a flow in a mold disclosed in any one of (1) to (3) above, the method used in thin-slab casting, wherein a magnetic flux density B (T) of a DC magnetic field to be applied and the distance L (m) from the lower end of the immersion nozzle to the lower end of the core satisfy Formulae (5) and (6) described below with respect to an average flow rate V (m/s) in the immersion nozzle:

$$L \geq L_C = (\rho V)/(2\sigma B^2) \quad \text{Formula (5)}$$

$$0.1 \times B\sqrt{((\sigma DV)/\rho)} \geq 0.1 \text{ (m/s)} \quad \text{Formula (6)}$$

wherein D represents the inner diameter (m) of the immersion nozzle, ρ represents a density ($kg/m^3$) of a molten metal, and σ represents an electric conductivity (S/m) of the molten metal.

(7) A third aspect of the present disclosure is a method for controlling a flow in a mold, the method using the device for controlling a flow in a mold disclosed in (4) or (5) above, the method used in thin-slab casting of steel, wherein a magnetic flux density B (T) of a DC magnetic field to be applied and the distance L (m) from the lower end of the immersion nozzle to the lower end of the core satisfy Formulae (5) and (6) described below with respect to an average flow rate V (m/s) in the immersion nozzle:

$$L \geq L_C = (\rho V)/(2\sigma B^2) \quad \text{Formula (5)}$$

$$0.1 \times B\sqrt{((\sigma DV)/\rho)} \geq 0.1 \text{ (m/s)} \quad \text{Formula (6)}$$

wherein D represents the inner diameter (m) of the immersion nozzle, ρ represents a density ($kg/m^3$) of a molten metal, and σ represents an electric conductivity (S/m) of the molten metal.

(8) In the method for controlling a flow in a mold disclosed in (7) above, the thickness of the copper plate $D_{Cu}$ on a long side of the mold, the thickness of the slab T, the frequency f (Hz) of the electromagnetic stirring unit, and the electric conductivity of the copper plate $\sigma_{Cu}$ may be adjusted to satisfy Formulae (7A) and (7B) described below:

$$D_{Cu} < \sqrt{(2/(\sigma_{Cu}\omega\mu))} \quad \text{Formula (7A)}$$

$$\sqrt{(1/(2\sigma\omega\mu))} < T \quad \text{Formula (7B)}$$

wherein ω represents the angular velocity (rad/sec) of 2πf, μ represents the magnetic permeability ($N/A^2$) of a vacuum of $4\pi \times 10^{-7}$, and σ represents the electric conductivity (S/m) of the molten steel.

(9) In the method for controlling a flow in a mold disclosed in (8) above, a stirring flow rate of the molten steel on the surface of the molten steel in the mold $V_R$ may satisfy Formula (8) described below:

$$V_R \geq 0.1 \times B\sqrt{((\sigma DV)/\rho)} \quad \text{Formula (8)}$$

wherein the stirring flow rate of the molten steel $V_R$ is determined based on a dendrite inclination angle in a cross section of the slab.

Effects

According to the present disclsoure, in thin-slab casting, by making the immersion nozzle discharge flow have the highest braking efficiency, the nozzle discharge flow can be braked and uniformly dispersed, and the meniscus can be supplied with heat. As a result, a slab excellent in both the surface and the inner quality can be cast. That is, the flow in the mold can be stably controlled under the condition of high throughput, and the productivity of the thin-slab casting process is dramatically improved. At the same time, a slab having high quality can be manufactured.

DETAILED DESCRIPTION

First, the point is described that in an unsolidified molten steel pool near the lower end of a mold, the downward flow rate of the molten steel is substantially uniform, that is, the nozzle discharge flow is formed that is suitable for electromagnetic braking for forming a plug flow.

The present inventors have studied to form a nozzle discharge flow that is a flat jet like spray in a secondary cooling zone and can provide momentum over the entire width in a mold.

Figure 2:
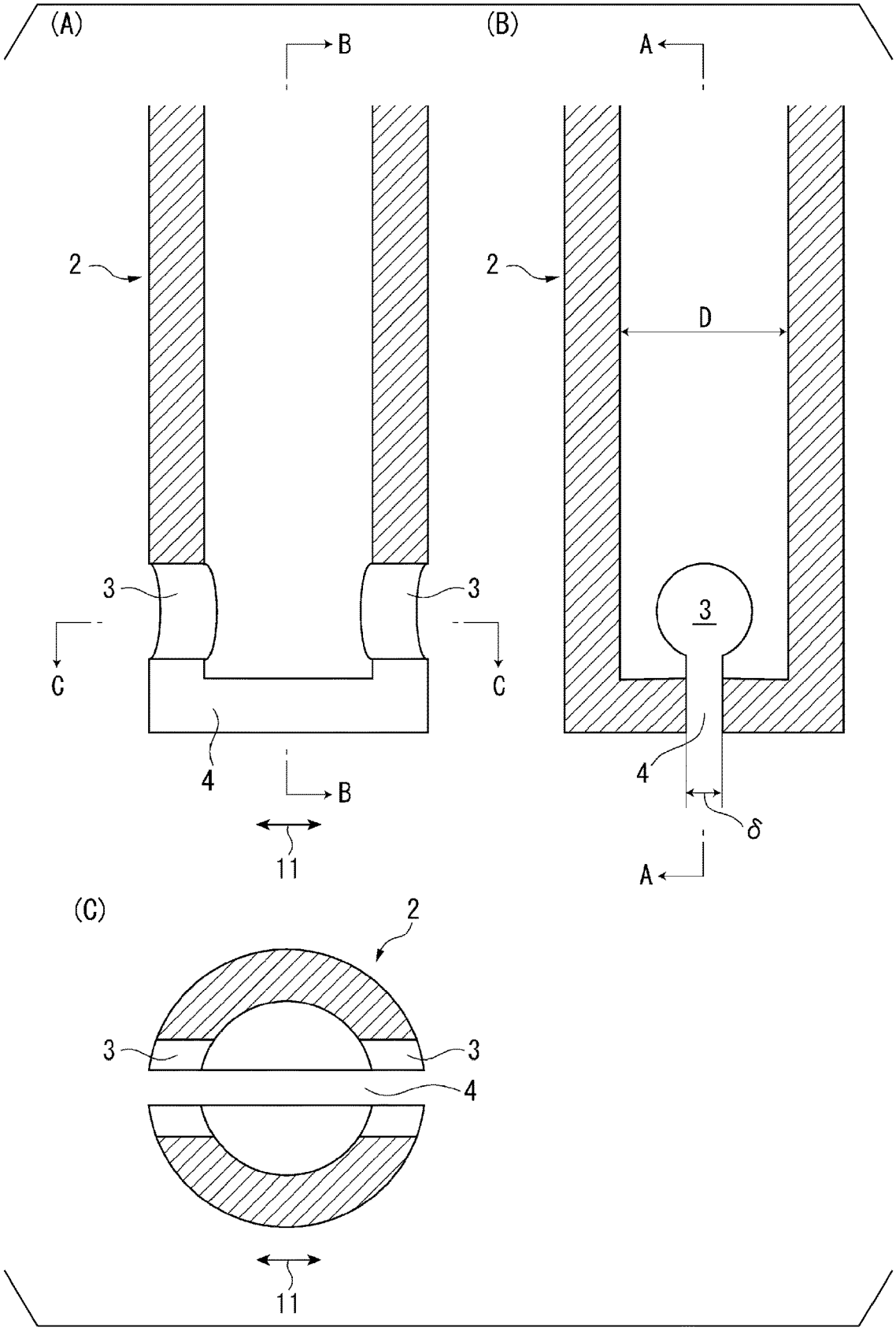
FIG. 2 is a view showing an example of an immersion nozzle, wherein (A) is a front sectional view taken along the line A-A, (B) is a side sectional view taken along the line B-B, and (C) is a plan sectional view taken along the line C-C.

As described above, in ordinary continuous casting that is not thin-slab casting, an Ar gas is blown into the molten metal passing through the immersion nozzle in order to, for example, prevent the immersion nozzle from clogging. As a result, in the case that a slit is provided at the bottom in addition to the discharge hole provided on the side surface of the immersion nozzle and the nozzle discharge flow is formed downward, bubbles blown downward along with the nozzle discharge flow directly floats upward, and as a result, the bubbles boil around the nozzle, and the nozzle discharge flow has not been well utilized. Meanwhile, in thin-slab casting in which the meniscus portion has a thickness on the short side of 150 mm or less, no Ar gas is blown into the molten metal passing through the immersion nozzle. Therefore, it is unnecessary to consider that Ar bubbles further disperse the nozzle discharge flow, and the downward nozzle discharge flow can be utilized. The present inventors first focused on this point, and decided to provide a slit 4 at the bottom of an immersion nozzle 2 in thin-slab casting as shown in FIG. 2. That is, the immersion nozzle 2 has two holes so that a discharge hole 3 is provided on each side surface generally used (each of both the side surfaces in a mold width direction 11), and the slit 4 is provided that leads to the bottom of the immersion nozzle 2 and the bottoms of the two discharge holes 3 and opens outside so that the two discharge holes 3 (hereinafter referred to as "two holes") are connected. As a result, it is possible to form a nozzle discharge flow that is a flat jet like spray in a secondary cooling zone and can provide momentum over the entire width in the mold.

Figure 3:
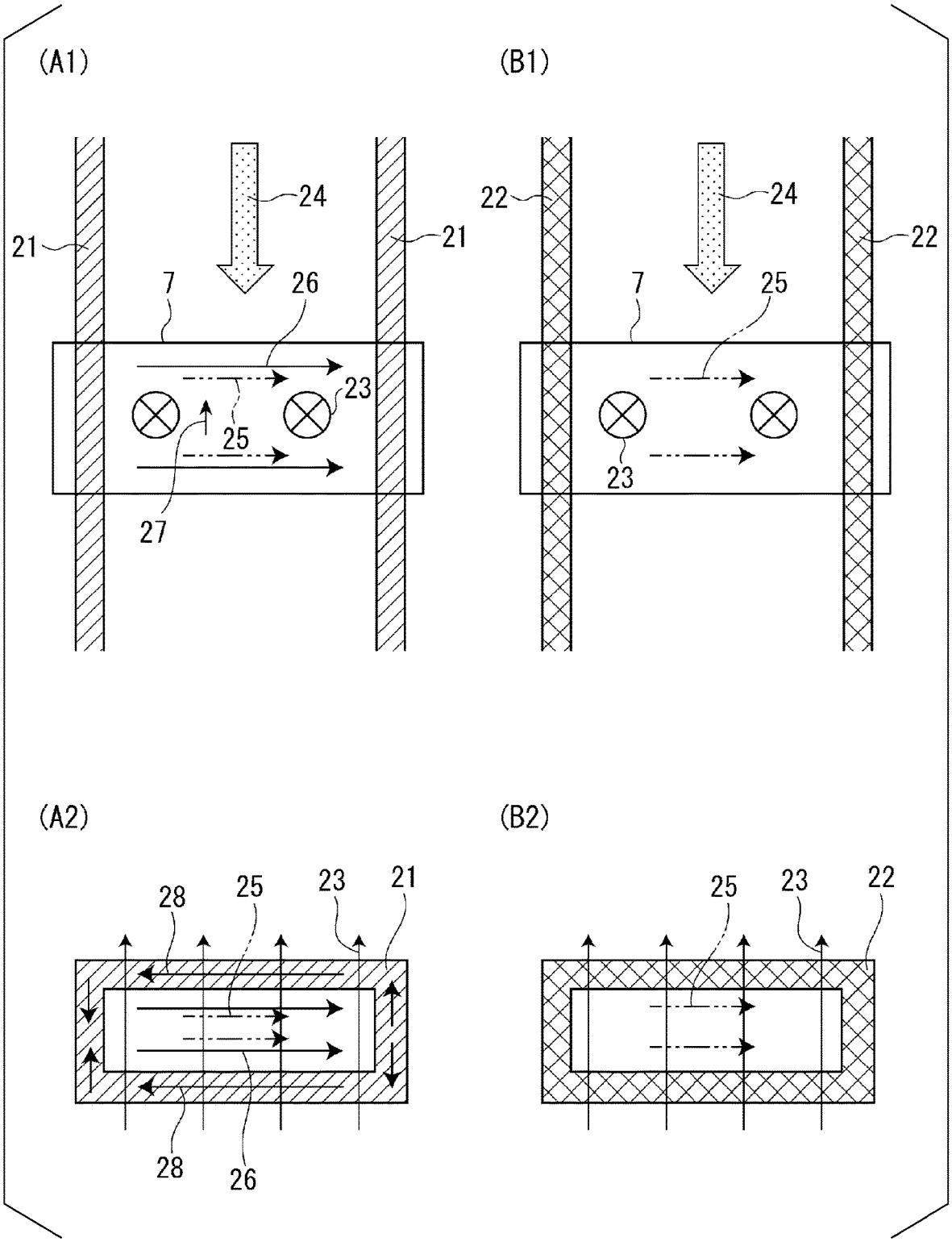
FIG. 3 is a view showing a state of generation of an induced current in a conductive fluid flowing in a magnetic field, wherein (A1) and (A2) show a case of a flow in a conductor, (B1) and (B2) show a case of a flow in an insulator, (A1) and (B1) are a front sectional view, and (A2) and (B2) are a plan sectional view.

When a DC magnetic field 23 is applied to molten steel flowing in one direction at right angles to the flowing direction of a molten steel flow 24 as shown in FIG. 3, an induced electromotive force 25 is generated in the flowing molten steel. In the drawings, the symbol with a cross in a circle indicates that the direction of the magnetic flux line of the DC magnetic field 23 is perpendicular to the paper surface and goes from the front to the back of the paper surface. The induced electromotive force 25 causes an induced current 26 to flow in the flowing molten steel. At this time, as shown in (A2) of FIG. 3, if a conductor 21 is present around the molten steel, a return path 28 is formed in the conductor 21, so that the induced current 26 actually flows and a braking force 27 due to electromagnetic braking is obtained. However, in the case that the molten steel flows in the flow path of an insulator such as a refractory 22 as shown in (B2) of FIG. 3, even if the induced electromotive force 25 is generated in the flowing molten steel, an induced current cannot flow because there is no route where the return path of the induced current flows, so that the braking force is canceled. That is, because an immersion nozzle generally includes a non-conductive refractory, electromagnetic braking cannot be obtained even if a DC magnetic field is applied to the flow in the immersion nozzle. It is clear that it is necessary to consider the formation of an induced current path in order to enhance the electromagnetic braking efficiency.

Then, as the next point of view, the present inventors have studied how to apply electromagnetic braking to the molten steel flow in the immersion nozzle. A case is considered in which a DC magnetic field is applied to the nozzle discharge hole portion of the immersion nozzle having each of the configurations a, b, and c described below.

Figure 4:
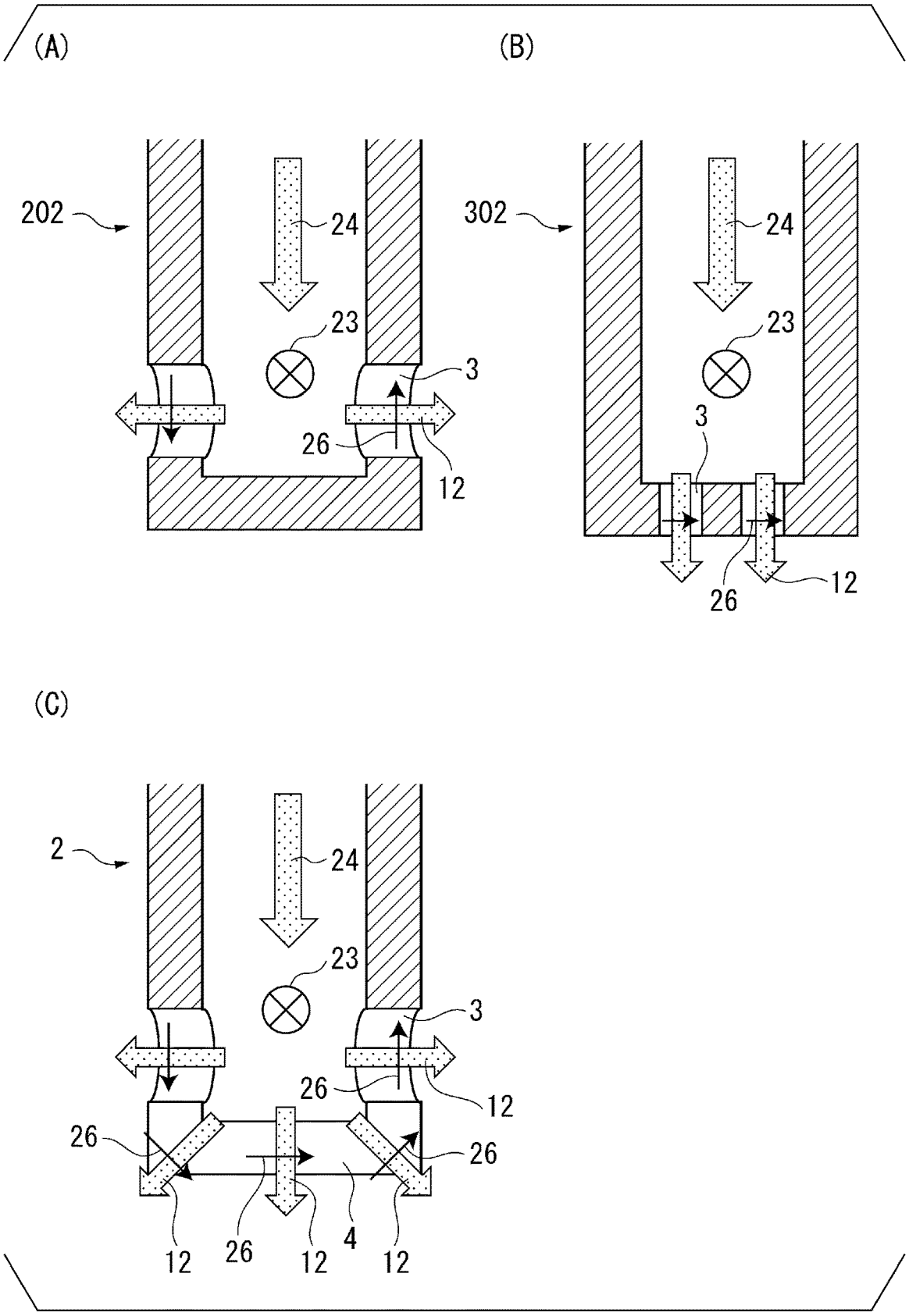
FIG. 4 is a view showing a state of an induced current generated in an immersion nozzle discharge flow in a magnetic field, wherein (A) shows a case of the immersion nozzle having a discharge hole on the side surface, (B) shows a case of the immersion nozzle having a discharge hole at the bottom, and (C) shows a case of the immersion nozzle having both a discharge hole on the side surface and a slit at the bottom.

Configuration a: an immersion nozzle 202 provided with the nozzle discharge hole 3 on each of both the side surfaces shown in (A) of FIG. 4.

Configuration b: an immersion nozzle 302 provided with a plurality of nozzle discharge holes 3 on the bottom surface of the nozzle as shown in (B) of FIG. 4.

Configuration c: an immersion nozzle 2 including the nozzle discharge hole 3 and the slit 4 at the bottom of the nozzle as shown in (C) of FIG. 4.

In the case of the configuration a in which the immersion nozzle 202 is used, even if the DC magnetic field 23 is applied to the flowing molten steel inside the discharge hole, a current path cannot be formed at the nozzle discharge hole portion, and a current path is formed outside the nozzle.

In the case of the configuration b in which the immersion nozzle 302 is used, no current path is formed at the nozzle discharge hole portion as in the configuration a, and no current path is formed also between adjacent nozzle discharge holes. Therefore, a current path is formed outside the nozzle.

Meanwhile, in the case of the configuration c in which the immersion nozzle 2 is used, a nozzle discharge flow 12 can be formed by the whole including the nozzle discharge hole 3 and the slit 4. According to such a configuration, because a current path can be formed without the limitation by the nozzle, the induced current 26 can be induced when the DC magnetic field 23 is applied to the discharge flow in the immersion nozzle 2, and a braking force can be applied.

The present inventors have conceived to use such an immersion nozzle 2 and to install a DC magnetic field generation unit 5 that can apply a uniform DC magnetic field in the thickness direction over the entire width of the mold. As a result, the height region, in which a core 6 is present that is the iron core of the electromagnet of the DC magnetic field generation unit 5, is a DC magnetic field zone 7. The immersion nozzle 2 forms a nozzle discharge flow from the two discharge holes 3 and the slit 4 at the bottom, therefore the discharge hole 3 portion and the slit 4 portion of the immersion nozzle 2 are arranged in the DC magnetic field zone 7 of the DC magnetic field generation unit 5. As a result of using the immersion nozzle 2 having such a shape of the discharge portion, a flat jet can be formed in the DC magnetic field zone. Therefore, the induced current flows not only in the jet region but also over the whole including the interval between the nozzle discharge holes, so that extremely efficient braking is possible. The immersion nozzle 2 may have an elliptical or rectangular cross section perpendicular to its axis direction.

Furthermore, with respect to a method for controlling a flow in a mold, the present inventors have found that it is effective that a core length below the nozzle L that is the distance from the lower end of the immersion nozzle 2 to the lower end of the core 6 satisfies Formula described below in order to, as described above, form a nozzle discharge flow that is a flat jet and can provide momentum over the entire width in the mold and, in addition, to brake the nozzle discharge flow.

$$L \geq L_C = (\rho V)/(2\sigma B^2) \qquad \text{Formula (5)}$$

In Formula (5) described above, ρ represents a density ($kg/m^3$) of a molten metal, and σ represents an electric conductivity (S/m) of the molten metal.

As described below, in the immersion nozzle 2 having the two discharge holes 3 and the slit 4, the flow rate of the discharge flow is almost equal to the average flow rate V in the immersion nozzle (the average flow rate in the vertical straight pipe of the immersion nozzle). The kinetic energy E of the fluid having a flow rate V can be expressed as $$E = (\rho V^2)/2 \qquad \text{Formula (5A).}$$

Furthermore, the braking force F applied to the conductive fluid that crosses the magnetic field having a magnetic flux density B at a flow rate V is expressed as $$F = \sigma V B^2 \qquad \text{Formula (5B).}$$

When the braking distance required for braking the flow rate of the fluid from a flow rate V to a flow rate of zero by the braking force F is represented by the required core length $L_C$, it is expected that $$L_C = E/F = (\rho V)/(2\sigma B^2) \qquad \text{Formula (5C).}$$

Figure 1:
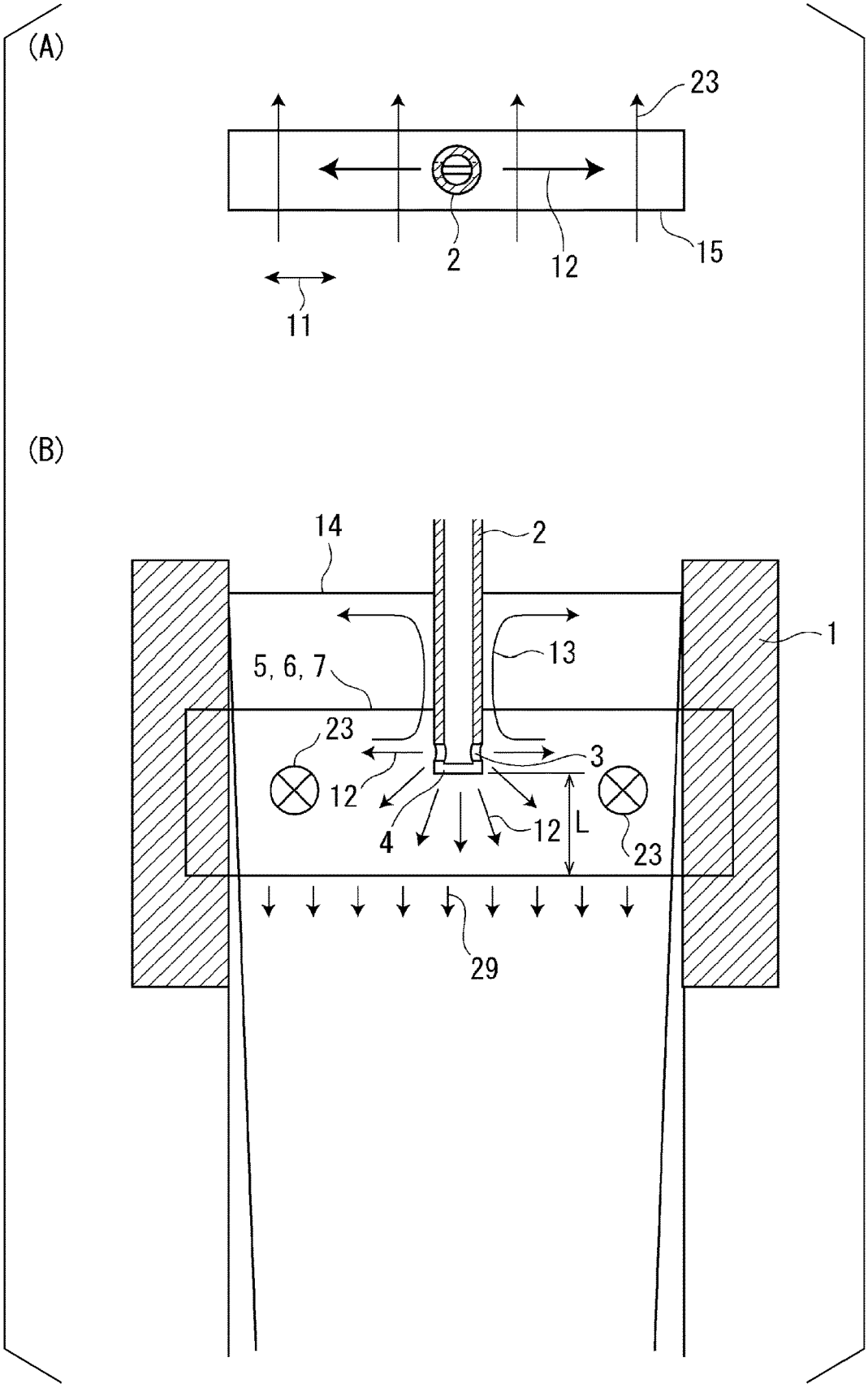
FIG. 1 is a view showing thin-slab continuous casting equipment having a device for controlling a flow in a mold according to an embodiment of the present disclosure, wherein (A) is a schematic plan view, and (B) is a schematic front view.
Figure 5:
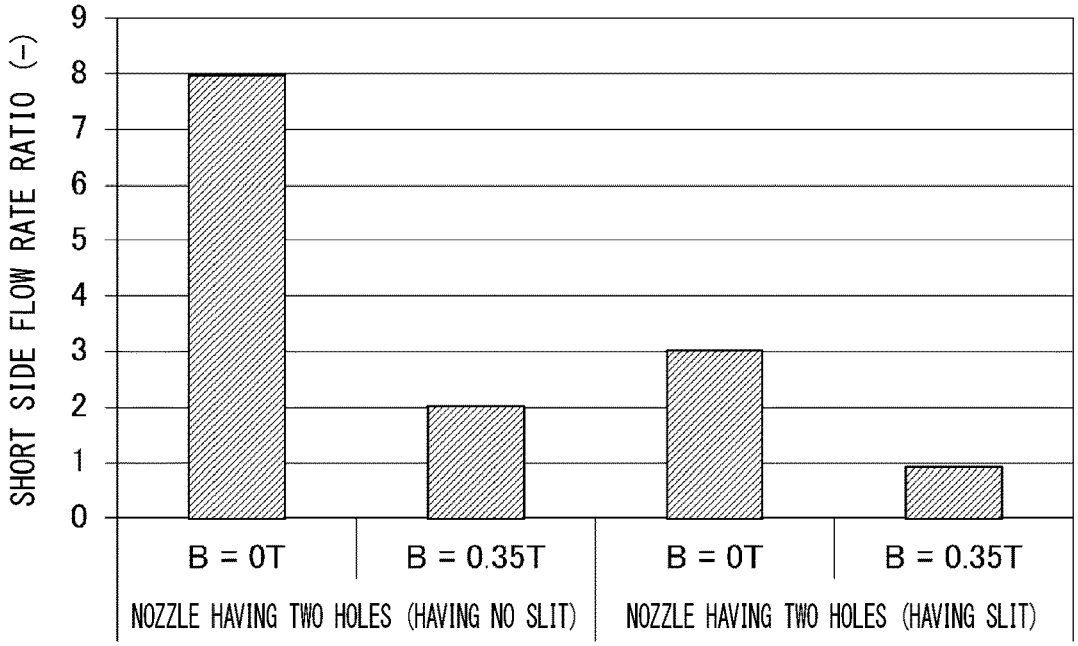
FIG. 5 is a graph showing the relationship between the presence or absence of a slit in an immersion nozzle, the presence or absence of a DC magnetic field, and the short side flow amount ratio in a casting test in which a conductive molten metal is used.
Figure 6:
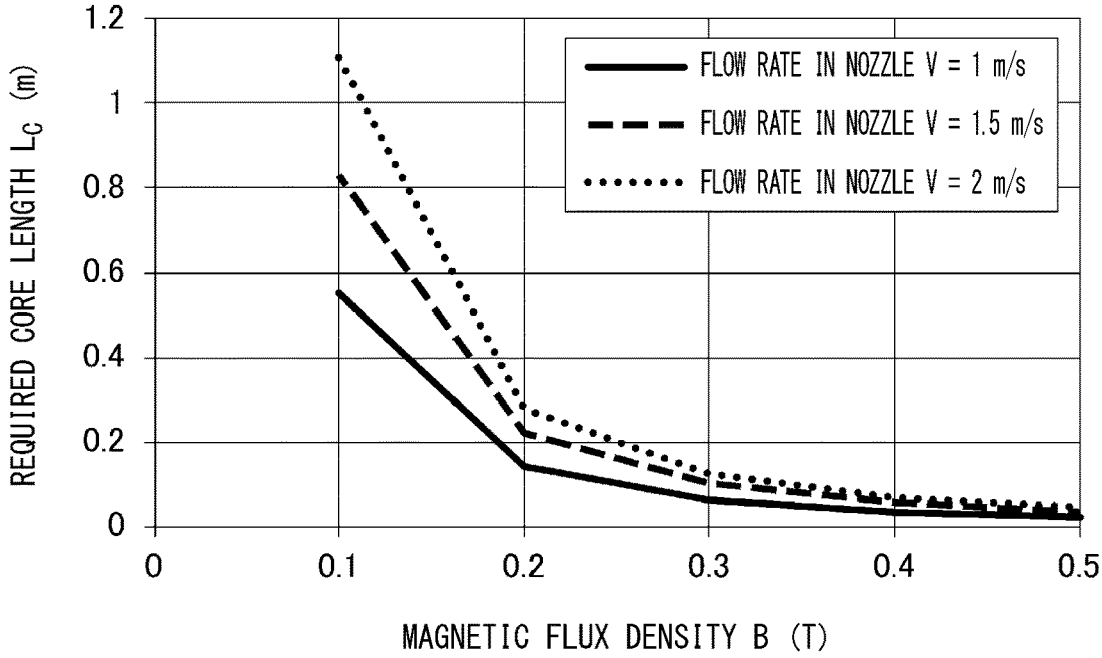
FIG. 6 is a graph showing the relationship between the magnetic flux density of a DC magnetic field, the flow rate in a nozzle, and the required core length.

Therefore, using a model experiment device simulating a molten steel pool in a mold and an immersion nozzle for thin-slab casting, an experiment in which a DC magnetic field is applied around the nozzle discharge flow was performed with a liquid of a Sn-10% Pb alloy as a conductive fluid. Specifically, the downward flow rate in the vicinity of the short side was investigated at a position of 0.2 m below the lower end of the core under the conditions of a magnetic flux density of B=0.35 T and a distance from the lower end of the immersion nozzle to the lower end of the core of L=0.06 m using the immersion nozzle 2 provided with the two discharge holes 3 and the slit 4 as shown in (C) of FIG. 4, and using the immersion nozzle 202 having no slit and two ordinary discharge holes as shown in (A) of FIG. 4. The downward flow rate in the vicinity of the short side was measured using an ultrasonic Doppler current meter. The measurement was performed for 1 minute under each condition, and the time average value was regarded as the measured value. The current meter was set at the center of the thickness and at a position of 20 mm from the inner wall of the short side. The temperature of the liquid was 220° C., the electric conductivity of the liquid was σ=2,100,000 S/m, and the density of the liquid was ρ=7,000 $kg/m^3$. $L_C$ calculated by Formula (5C) described above is $L_C$=0.018 m, and $L \geq L_C$. FIG. 5 shows the results of investigating the effects of the presence or absence of magnetic flux on the two kinds of immersion nozzles. The "short side flow rate ratio" shown by the vertical axis in FIG. 5 indicates a value obtained by dividing the measured downward flow rate in the vicinity of the short side by the average flow rate (a value obtained by dividing the average flow amount by the cross-sectional area of the pool), and if the short side flow rate ratio is 1, it is indicated that the downward flow rate is uniform in the mold width direction in the vicinity of the lower end of the core. By using the immersion nozzle 2 as shown in (C) of FIG. 4, the short side downward flow rate can be reduced even under the condition of applying no magnetic field, and in addition, it is clear that under the condition of applying a magnetic field so that Formula (5) described above is satisfied, the flow rate ratio is almost 1, that is, a plug flow 29 in FIG. 1 is formed. Based on the above-described results, FIG. 6 shows the relationship between the magnetic flux density B, the average flow rate V in the nozzle, and the required core length $L_C$ in the case of molten steel.

Next, how to supply heat to the meniscus in the mold will be described.

When a DC magnetic field is applied to the molten steel pool in the mold and the discharge flow from the immersion nozzle flows in the DC magnetic field, an induced electromotive force is generated in the flowing molten steel, and an induced current flows in the flowing molten steel. Because the induced current needs to be formed into a closed loop, the induced current flows in the stationary molten steel outside the flowing molten steel to form a closed loop current. Due to the action of the induced current flowing in the stationary molten steel and the DC magnetic field, a force acts on the stationary molten steel in the direction opposite to the discharge flow, and at the end of the above-described jet, the induced current to brake the jet accelerates the surroundings in the direction opposite to the jet, and a flow is generated in the direction opposite to the discharge flow. The flow is generally called a counter flow. The counter flow is formed along the nozzle discharge flow, and when the counter flow reaches the nozzle side surface, the counter flow flows upward along the nozzle side surface.

Therefore, the present inventors have conceived a technical idea of utilizing the upward flow caused by the counter flow as a heat supplier to the meniscus.

First, a low melting point alloy experiment was performed to observe the counter flow. Under the conditions of the low melting point alloy experiment described above, it was observed in detail how the state in the vicinity of the liquid surface around the nozzle changed depending on the magnetic field to be applied, the flow rate in the nozzle, and the presence or absence of the Ar gas blown into the immersion nozzle. As a result, an upward flow (counter flow) was observed on the side surface around the nozzle (immediately above the two holes of the nozzle) under a certain condition when the magnetic flux density to be applied was increased. Furthermore, the counter flow was remarkable under the condition of the presence of the blowing-in of an Ar gas (at a volume flow amount of 10% of the liquid metal). This is particularly because the Ar bubbles blown along with the downward jet directly float around the nozzle and the Ar bubbles float along with the counter flow. In thin-slab casting, no Ar gas is blown into the nozzle, therefore it is required to consider only the flow of the liquid metal and the flow caused by the interaction with the magnetic field. The counter flow formed around the nozzle rises to the meniscus and then flows from the nozzle toward the short side.

Figure 7:
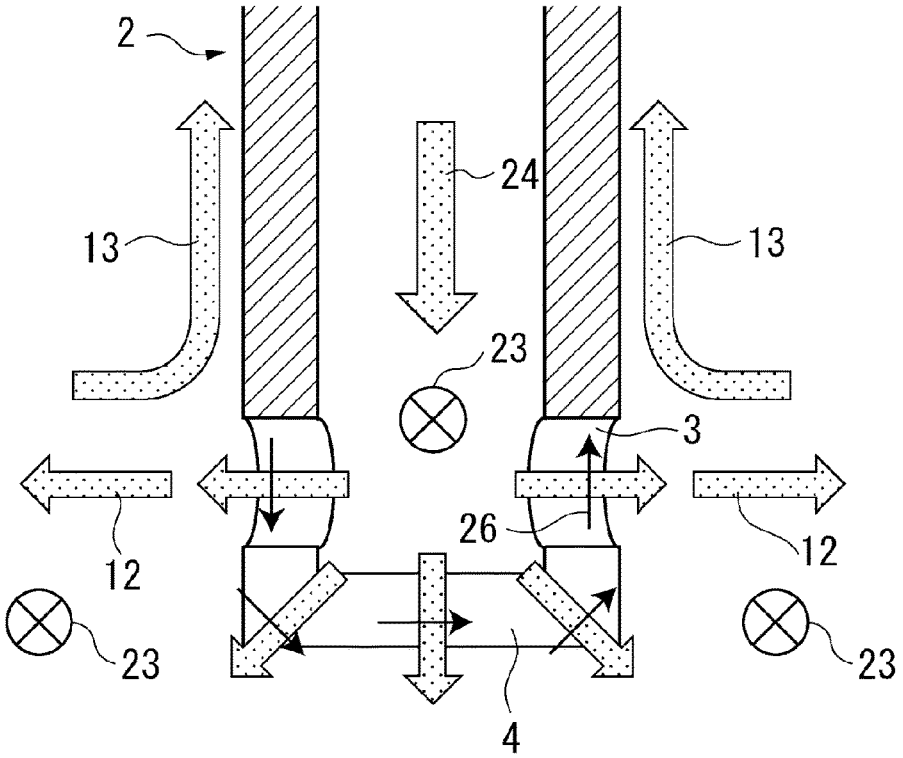
FIG. 7 is a schematic sectional view showing the relationship between a discharge flow from an immersion nozzle having a slit and a counter flow.
Figure 8:
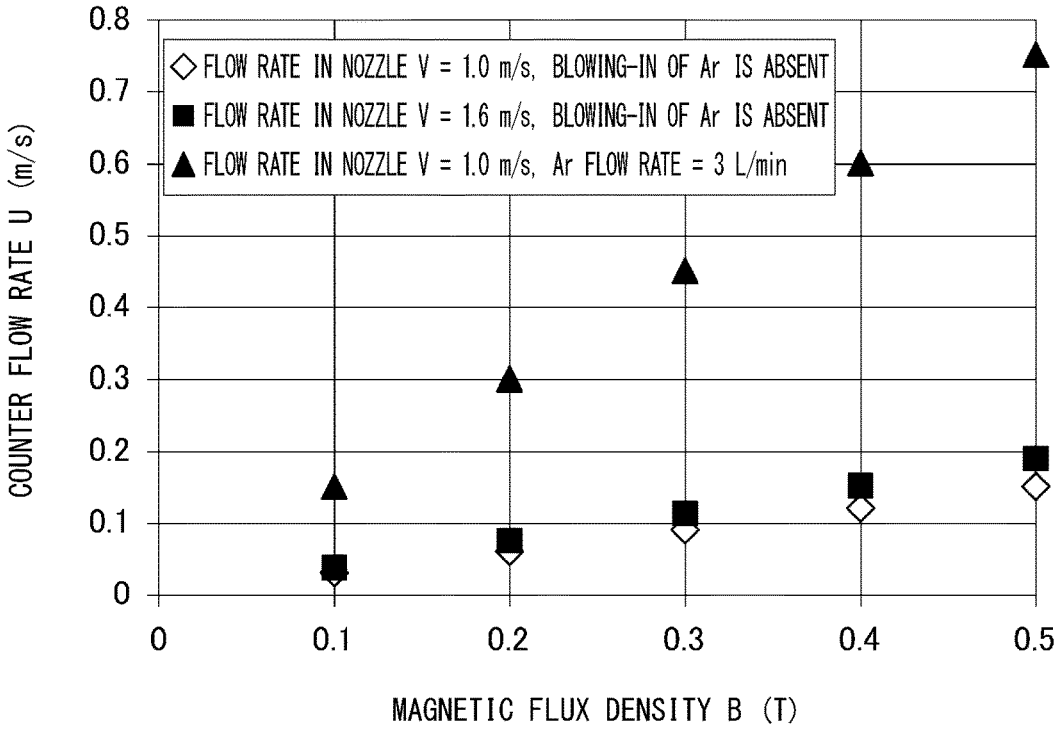
FIG. 8 is a graph showing the relationship between the magnetic flux density of a DC magnetic field, the flow rate in a nozzle, the presence or absence of the blowing-in of an Ar gas, and the counter flow rate in a casting test in which a conductive molten metal is used.

Then, next, in the actual thin-slab continuous casting of molten steel, the flow from the nozzle toward the short side was regarded as the counter flow, and the flow rate was measured. In the measurement, the molten steel velocity meter described below was used. In the velocity meter, a molybdenum cermet rod is immersed in molten steel, the inertial force acting on the immersed portion is measured with a strain gauge attached to the end of the molybdenum cermet rod, and the measured value is converted into the flow rate. The measurement was performed for 1 minute under each condition, and the time average value was regarded as the measured value. The above-described velocity meter was immersed, and the flow rate was measured at a position of 50 mm from the nozzle side surface at a depth to 50 mm from the meniscus. As for the mold size, the casting width was 1.2 m, and the casting thickness (the thickness of the short side of the meniscus portion) was 0.15 m. The average flow rate V in the immersion nozzle was 1.0 or 1.6 m/s. The magnetic flux density B of the magnetic field was changed in the range of 0.1 to 0.5 T, and the relationship between the condition of the presence or absence of the blowing-in of an Ar gas and the flow rate U of the counter flow was investigated. As the immersion nozzle 2, an immersion nozzle having a nozzle inner diameter (an inner diameter of the vertical straight pipe of the immersion nozzle 2) of D, the two discharge holes 3 (hole diameter: d), and the slit 4 (slit thickness: δ) in which d/D=0.5 and δ/D=0.2 was used. FIG. 7 shows a schematic view of the relationship between the discharge flow 12 and a counter flow 13 in the immersion nozzle 2. FIG. 8 shows the measurement results. It can be seen that the flow rate U of the counter flow 13 is proportional to the square root of the average flow rate V in the nozzle and changes proportionally to the magnetic flux density B, and that the counter flow rate is more remarkable under the condition of the presence of the blowing-in of an Ar gas. As a result of an experiment in which the nozzle inner diameter D was changed, it has been found that the flow rate U of the counter flow is proportional to the square root of the nozzle inner diameter D. In the case that the inner circumference of the straight pipe of the immersion nozzle 2 is not a perfect circle (is, for example, an ellipse or a rectangle), the equivalent diameter of a circle having the same cross-sectional area is defined as the inner diameter of the immersion nozzle D.

From these results, it has been found that the flow rate U of the counter flow is determined using the magnetic flux density B, the average flow rate V in the nozzle, the nozzle inner diameter D, the density ρ of the liquid metal, and the electric conductivity σ with Formula (6A) described below: $aB\sqrt{((\sigma DV)/\rho)}$. Here, a is a parameter, and when a is set to 0.1 under the condition of the absence of the blowing-in of Ar and to 0.5 under the condition of the presence of the blowing-in of Ar, the determined value corresponds well with the experimental result. It has been also found that by setting the flow rate U of the counter flow to 0.1 m/s or faster, the upward flow caused by the counter flow can be utilized as a heat supplier to the meniscus.

$$U=aB\sqrt{(\sigma DV)/\rho}\geq 0.1 \text{ (m/s)} \qquad \text{Formula (6A)}$$

Blowing-in of Ar gas being absent: a=0.1, blowing-in of Ar gas being present: a=0.5 wherein D represents the inner diameter (m) of the immersion nozzle, ρ represents a density (kg/m$^3$) of a molten metal, and σ represents an electric conductivity (S/m) of the molten metal.

Since the blowing-in of Ar is not performed in thin-slab casting, an upward flow can be formed around the nozzle by applying a magnetic flux density B that satisfies Formula (6) described below in which a in Formula (6A) is substituted by 0.1. As a result, it is expected that the supply of heat to the meniscus and, in addition, the formation of an upward flow above the nozzle discharge flow facilitate the floating of the inclusion. A strong magnetic field is required to be applied to form a counter flow, and in thin-slab casting, when an electromagnet is installed at the back of the copper plate forming the long-side mold, the distance between the magnetic poles is preferably short because of the thin casting thickness. The maximum value of the magnetic flux density of the magnetic field to be applied is 1 T.

$$0.1\times B\sqrt{((\sigma DV)/\rho)}\geq 0.1 \text{ (m/s)} \qquad \text{Formula (6)}$$

wherein D represents the inner diameter (m) of the immersion nozzle, ρ represents a density (kg/m$^3$) of a molten metal, and σ represents an electric conductivity (S/m) of the molten metal.

As described above, by controlling the shape of the nozzle discharge flow, arranging the above-described nozzle discharge hole in the uniform magnetic field, and supplying molten steel into the mold, the nozzle discharge flow is braked and, at the same time, a counter flow formed only at the end of the jet is formed only on the nozzle side surface, therefore utilizing as a heat supplier to the meniscus and a facilitator of the floating of the inclusion is possible. As a result, by making the immersion nozzle discharge flow have the highest braking efficiency, the nozzle discharge flow can be braked, the downward flow rate in the mold can be uniform by uniformly dispersing the nozzle discharge flow, the meniscus can be supplied with heat by utilizing the counter flow, and the inclusion can be facilitated to float. Therefore, a slab excellent in both the surface and the inner quality can be cast.

Furthermore, the present inventors have also found that when the discharge flow from the nozzle discharge hole is formed so as to be substantially perpendicular (85° to 95°) to the axis direction of the immersion nozzle, a counter flow can be further preferably generated, and the counter flow is preferable as a heat supplier to the meniscus and as a facilitator of the floating of the inclusion.

Hereinafter, a device for controlling a flow in a mold in thin-slab casting of steel according to an embodiment of the present disclosure made based on the above-described findings (hereinafter, sometimes referred to as device for controlling a flow in a mold according to the present embodiment) will be described.

The device for controlling a flow in a mold according to the present embodiment is used for thin-slab casting in which the meniscus portion has a short side thickness of 150 mm or less and a casting width of 2 m or less. The lower limit of the short side thickness of the meniscus portion is not particularly limited, and may be more than 100 mm.

The device for controlling a flow in a mold according to the present embodiment includes the DC magnetic field generation unit 5 and the immersion nozzle 2.

The DC magnetic field generation unit 5 has the core 6 that applies a DC magnetic field toward the thickness direction of a mold 1 in the entire width in the width direction of the mold 1.

The immersion nozzle 2 has the discharge hole 3 formed on each of both side surfaces in the width direction of the mold 1 and has the slit 4 formed at the bottom so that the slit 4 leads to the bottom of each discharge hole 3 and opens outside.

The discharge hole 3 and the slit 4 of the immersion nozzle 2 are arranged so as to be present in the DC magnetic field zone that is in the height region in which the core 6 of the DC magnetic field generation unit 5 is present.

In the present embodiment, in thin-slab casting, the casting speed is 3 to 5 m/min. Since the inner diameter of the immersion nozzle D is about 100 mm, in this case, the average flow rate V in the nozzle is 1.0 m/s to 2.0 m/s, and usually about 1.5 m/s. Since the electric conductivity of the molten steel is σ=650,000 S/m and the density of the molten steel is ρ=7,200 kg/m$^3$, the magnetic flux density B (T) of the DC magnetic field to be applied is required to be 0.35 T or more in order to satisfy Formula (6) described above. Meanwhile, the upper limit of the magnetic flux density B is about 1.0 T. That is, it is required to satisfy Formula (1) described below. Under the condition of the magnetic flux density in the range shown in Formula (1) described below, Formula (5) described above can be satisfied if the distance L (m) from the lower end of the immersion nozzle to the lower end of the core is 0.06 m or more. That is, it is required just to satisfy Formula (2) described below. Therefore, the device for controlling a flow in a mold according to the present disclosure in the case of casting molten steel into a thin slab satisfies Formulae described below.

$$0.35T \leq B \leq 1.0T \quad \text{Formula (1)}$$

$$L \geq 0.06 \text{ m} \quad \text{Formula (2)}$$

Next, a preferable shape of the immersion nozzle will be described.

Here, in order to investigate the preferable relationship between the thickness of the slit 4 δ, the inner diameter of the immersion nozzle 2 D, the discharge hole diameter of the two holes (discharge hole 3) d, and the flow rate of the discharge flow 12 from the discharge hole 3 and the slit 4, a water model experiment was performed to examine. The shape of the discharge hole 3 on the side surface was a circle with a slit. The total area of the circle and the slit was determined, and the equivalent diameter of the circle having the same cross-sectional area was defined as the discharge hole diameter d. The same procedure can be employed in the case of a rectangular discharge hole. In the experiment, the states of the flows around the nozzle discharge hole 3 and the slit 4 were observed, and the flow rates in front of each discharge hole and the slit were measured. The flow rate Va in front of the two holes (discharge hole 3) and the flow rate Vb in front of the slit 4 at the lower end of the nozzle were measured. The average flow rate of the water in the nozzle inner diameter portion of the immersion nozzle 2 is represented by V. As a result, if the relationship between the slit thickness δ, the discharge hole diameter of the two holes d, and the nozzle inner diameter D satisfies Formulae described below, the nozzle discharge flow that is a flat jet and applies momentum over the entire width in the mold can be stably formed.

$$D/8 \leq \delta \leq D/3 \quad \text{Formula (3)}$$

$$\delta \leq d \leq 2/3 \times D \quad \text{Formula (4)}$$

Specifically, first, when the slit thickness δ was less than ⅛ of the nozzle inner diameter D, the discharge flow from the entire slit was not sufficiently formed. In contrast, when the slit thickness δ was more than ⅓ of the nozzle inner diameter D, the flow from the slit was a main flow, suction occurred depending on the hole diameter of the two holes d in contrast, and the nozzle discharge flow was slightly unstable. Next, as for the discharge hole diameter of the two holes, the preferable lower limit needs to be more than the lower limit of the slit thickness because the flow rate at both the ends of the flat jet is preferably faster than that at the slit. This is for the purpose of the momentum and heat supply to the short side. As for the preferable upper limit, it has been found that when the upper limit is more than ⅔ of the nozzle inner diameter D, a suction flow is generated under the condition of providing the slit and the nozzle discharge flow is destabilized. Therefore, if Formulae described above are satisfied, it is possible to form a preferable nozzle discharge flow that is a flat jet and applies momentum over the entire width in the mold.

Figure 9:
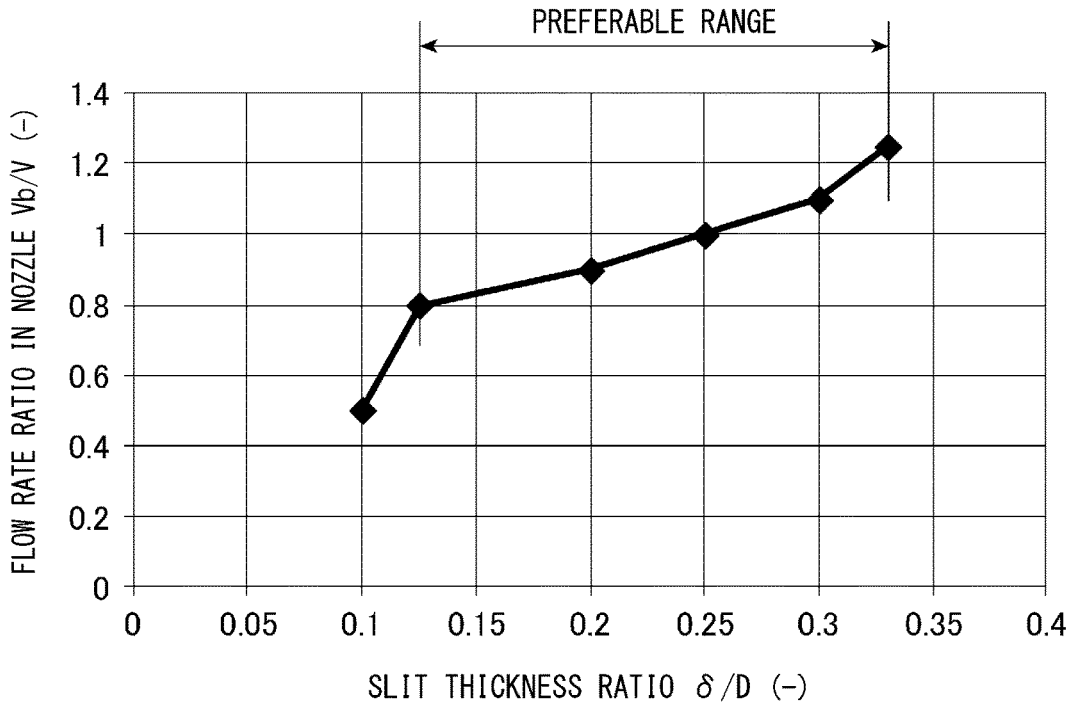
FIG. 9 is a graph showing the relationship between the slit thickness ratio ($\delta/D$) and the flow rate ratio ($Vb/V$) in a nozzle.
Figure 10:
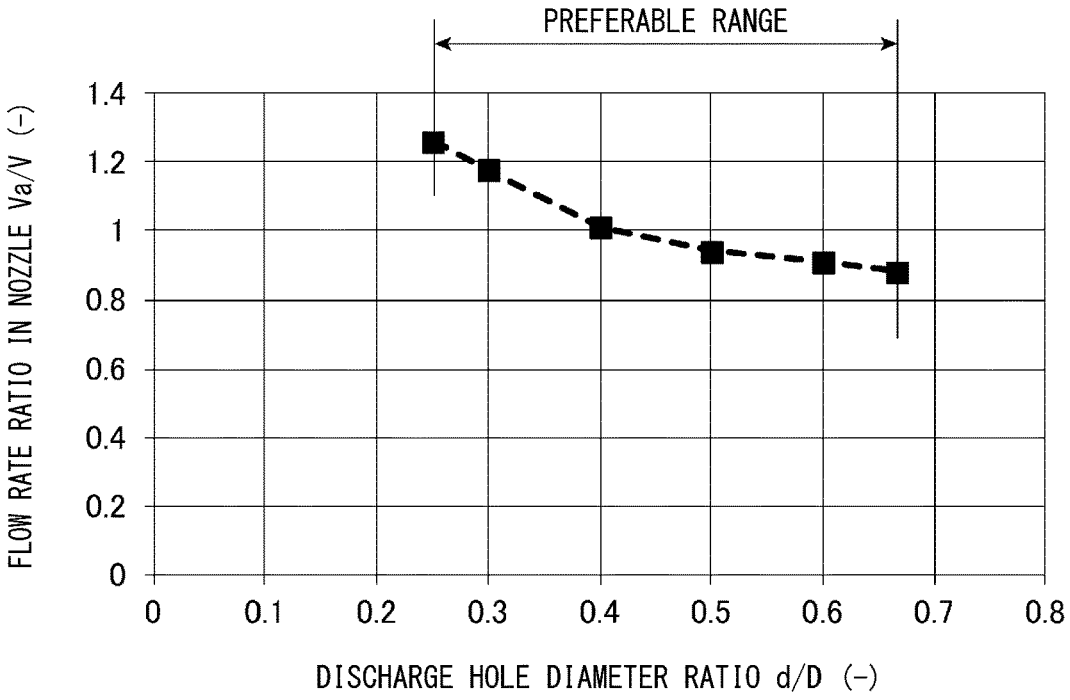
FIG. 10 is a graph showing the relationship between the discharge hole diameter ratio ($d/D$) and the flow rate ratio ($Va/V$) in a nozzle.

The slit thickness ratio δ/D was changed while d/D=0.4 was kept constant, and the relationship of Vb/V was plotted in FIG. 9. Furthermore, the discharge hole diameter ratio d/D was changed while δ/D=0.25 was kept constant, and the relationship of Va/V was plotted in FIG. 10. If both Vb/V and Va/V are in the range of 0.8 to 1.3, a uniform flow can be stably realized. As is clear from FIGS. 9 and 10, it is preferable that Formulae (3) and (4) described above be satisfied because under such a condition, both Vb/V and Va/V can be in the range of 0.8 to 1.3.

As described above, in the device for controlling a flow in a mold according to the present embodiment, the upward flow caused by the counter flow is utilized as a heat supplier to the meniscus. When the high-speed nozzle discharge flow is braked by the strong magnetic field, a counter flow is formed along the immersion nozzle side surface. This flow rises along the nozzle side wall, and on the molten steel surface in the mold, as shown in (A) of FIG. 11, the counter flow 13 is a flow from the immersion nozzle 2 toward the short side, and in the meniscus, the counter flow 13 spreads radially. As described above, in the actual thin-slab continuous casting of molten steel, the flow from the nozzle toward the short side was regarded as the counter flow, and the flow rate was able to be measured.

Figure 11:
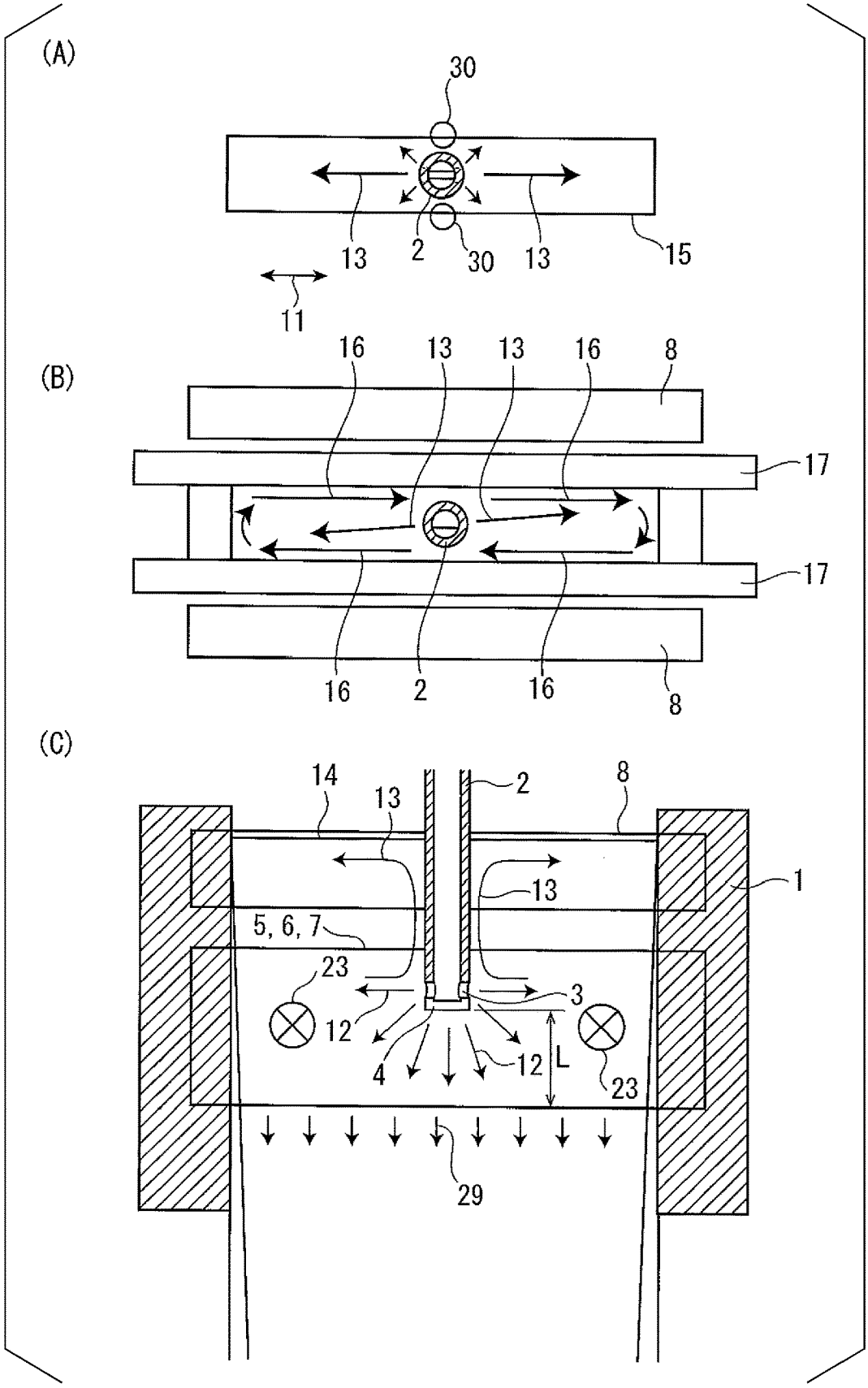
FIG. 11 is a view illustrating in-mold electromagnetic stirring, wherein (A) shows the surface of molten steel in a mold without in-mold electromagnetic stirring, (B) shows the surface of molten steel in a mold with in-mold electromagnetic stirring, and (C) is a front sectional view of (B).

At the center of the width of the inner surface of the mold, the flows rising along the left and the right side surfaces of the immersion nozzle collide, so that a stagnation point 30 is formed as also shown in (A) of FIG. 11. The stagnation point 30 is not preferable because it causes the decrease in the molten steel temperature and becomes a starting point of capturing the inclusion.

If a swirling flow of the molten steel can be formed on the surface of the molten steel in the mold, there is a possibility that the stagnation point 30 is eliminated. However, as described above, in thin-slab casting, in-mold electromagnetic stirring used in general slab continuous casting has not been used. Therefore, a method of forming a swirling flow in the meniscus portion was further examined.

The present inventors examined the conditions to form a stirring flow 16 on the surface of molten steel in the mold in thin-slab casting in which the slab thickness is 150 mm or less.

For this purpose, first, it is important that the skin depth of the AC magnetic field formed by an electromagnetic stirring unit 8 is larger than the thickness $D_{Cu}$ of the copper plate forming a mold long side wall 17. This condition is specified by Formula (7A) described below. That is, it is important that the skin depth of the electromagnetic field in the conductor is larger than the copper plate thickness $D_{Cu}$.

$$D_{Cu}<\sqrt{(2/(\sigma_{Cu}\omega\mu))} \quad \text{Formula (7A)}$$

Conventionally, in thin-slab casting in which the slab thickness T is 150 mm or less, it has been impossible to form a swirling flow in the molten steel in the mold even if an electromagnetic stirring thrust is applied so that a swirling flow is formed in the mold. The present inventors have found, for the first time, that a swirling flow is formed at the molten metal surface level by setting the frequency at which the skin depth of the electromagnetic force formed in the molten steel by the electromagnetic stirring unit is smaller than the slab thickness T so that the electromagnetic fields formed in the mold do not interfere with each other. The electromagnetic fields are formed by the electromagnetic stirring unit installed at the back of each of the two long side walls 17 facing each other. This condition is specified by Formula (7B). Formula (7B) described above shows the relationship between the skin depth of the electromagnetic force and the slab thickness T, and the skin depth of the electromagnetic force is specified as ½ of the skin depth of the electromagnetic field in the conductor. The reason is that the electromagnetic force is the product, the current density× the magnetic flux density, and the penetration of the current density and the magnetic field into the conductor is described by $\sqrt{(2/(\sigma\omega\mu))}$, so that the skin depth of the electromagnetic force that is the above-described product is $\frac{1}{2}\times\sqrt{(2/(\sigma\omega\mu))}$ that is described by $\sqrt{(1/(2\sigma\omega\mu))}$.

$$\sqrt{(1/(2\sigma\omega\mu))}<T \quad \text{Formula (7B)}$$

In Formulae (7A) and (7B) described above, ω represents the angular velocity (rad/sec) of 2πf, μ represents the magnetic permeability ($N/A^2$) of a vacuum, $D_{Cu}$ represents the mold copper plate thickness (mm), T represents the slab thickness (mm), f represents the frequency (Hz), σ represents the electric conductivity (S/m) of the molten steel, and $\sigma_{Cu}$ represents the electric conductivity (S/m) of the copper plate.

It has been possible for the first time to form a swirling flow having a sufficient flow rate in the mold in thin-slab casting in which the slab thickness is 150 mm or less by the electromagnetic stirring at a high frequency specified by Formula (7B). In the conventional in-mold electromagnetic stirring, a low frequency has been generally used in order to reduce the energy loss in the mold copper plate. The electric conductivity of the molten steel and the electric conductivity of the copper plate may be measured using a commercially available electric conductivity meter.

Figure 12:
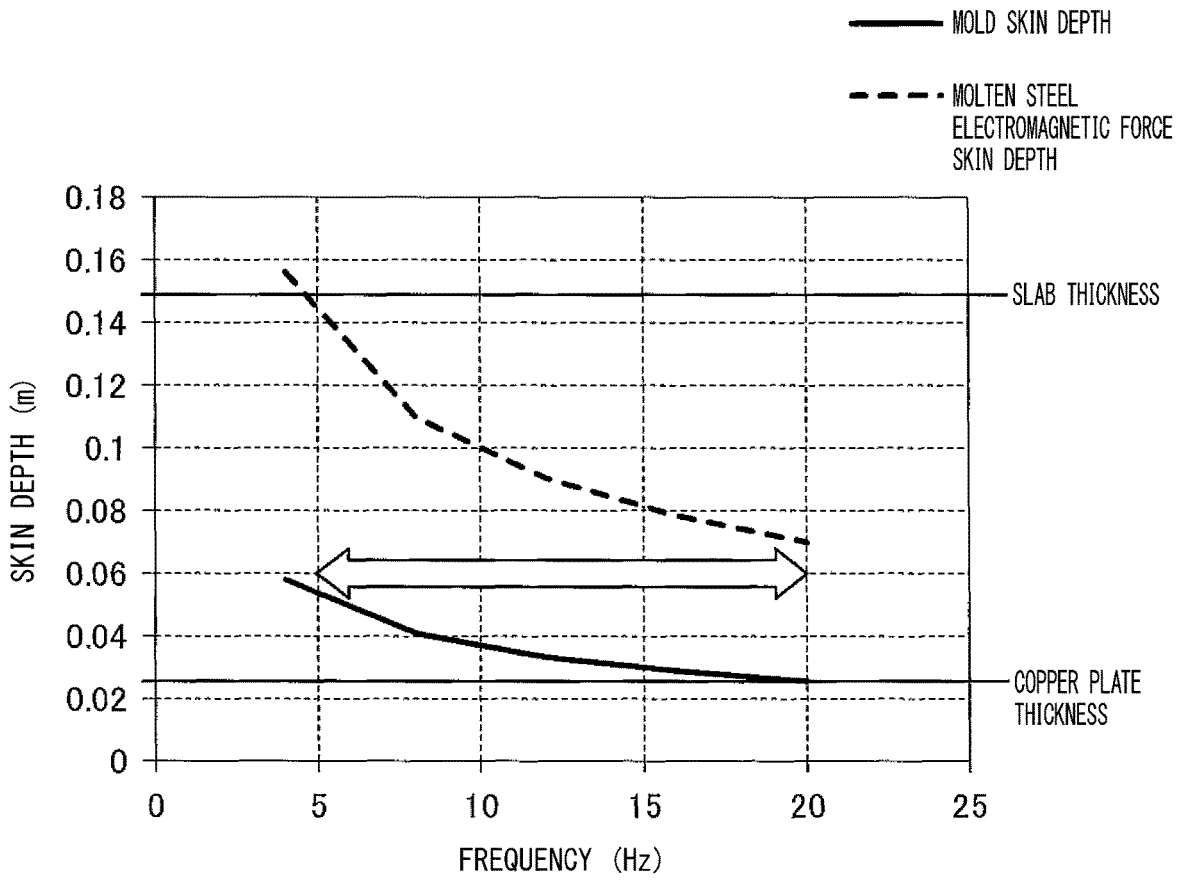
FIG. 12 is a graph showing the effects of the frequency of electromagnetic stirring on the mold skin depth and the molten steel electromagnetic force skin depth.

FIG. 12 shows an example of the effects of the frequency of electromagnetic stirring on the mold skin depth and the molten steel electromagnetic force skin depth. When the thickness $D_{Cu}$ of the copper plate forming the long side wall of the mold 1 is 25 mm and the electromagnetic stirring frequency f is set to be lower than 20 Hz, Formula (7A) can be satisfied. When the slab thickness T in the mold is 150 mm and the electromagnetic stirring frequency f is set to be higher than 5 Hz, Formula (7B) can be satisfied.

As described above, in thin-slab casting, by installing the electromagnetic stirring unit in the mold and adjusting the frequency of the alternating current applied to the electromagnetic stirring unit, a swirling flow is formed in the vicinity of the molten metal surface level even in the thin-slab casting in which the slab thickness is 150 mm or less. As a result, the occurrence of the stagnation point 30 can be eliminated, the decrease in the molten steel temperature can be prevented, and the stagnation point 30 can be prevented from becoming a starting point of capturing the inclusion.

As described above, the present inventors have clarified the conditions to form a stirring flow in the meniscus portion in thin-slab casting in which the slab thickness is 150 mm or less. Then, several molds having different mold copper plate materials and different thicknesses were manufactured, and casting was performed under the conditions that alternating currents having different frequencies were applied to the electromagnetic stirring unit. In addition, with respect to the center of the width of the cast slab, the solidified structure was examined from the center in the width direction, the inclination angle of the dendrite growing inward from the slab surface, that is, the angle with respect to the vertical line of the long side surface was measured, and the stirring flow rate $V_R$ was determined using the formula of Okano described in Non-Patent Document 2. Furthermore, the relationship with the flow rate U of the counter flow 13 was investigated. The flow rate U of the counter flow 13 can be determined by Formula (6A) described above.

Figure 13:
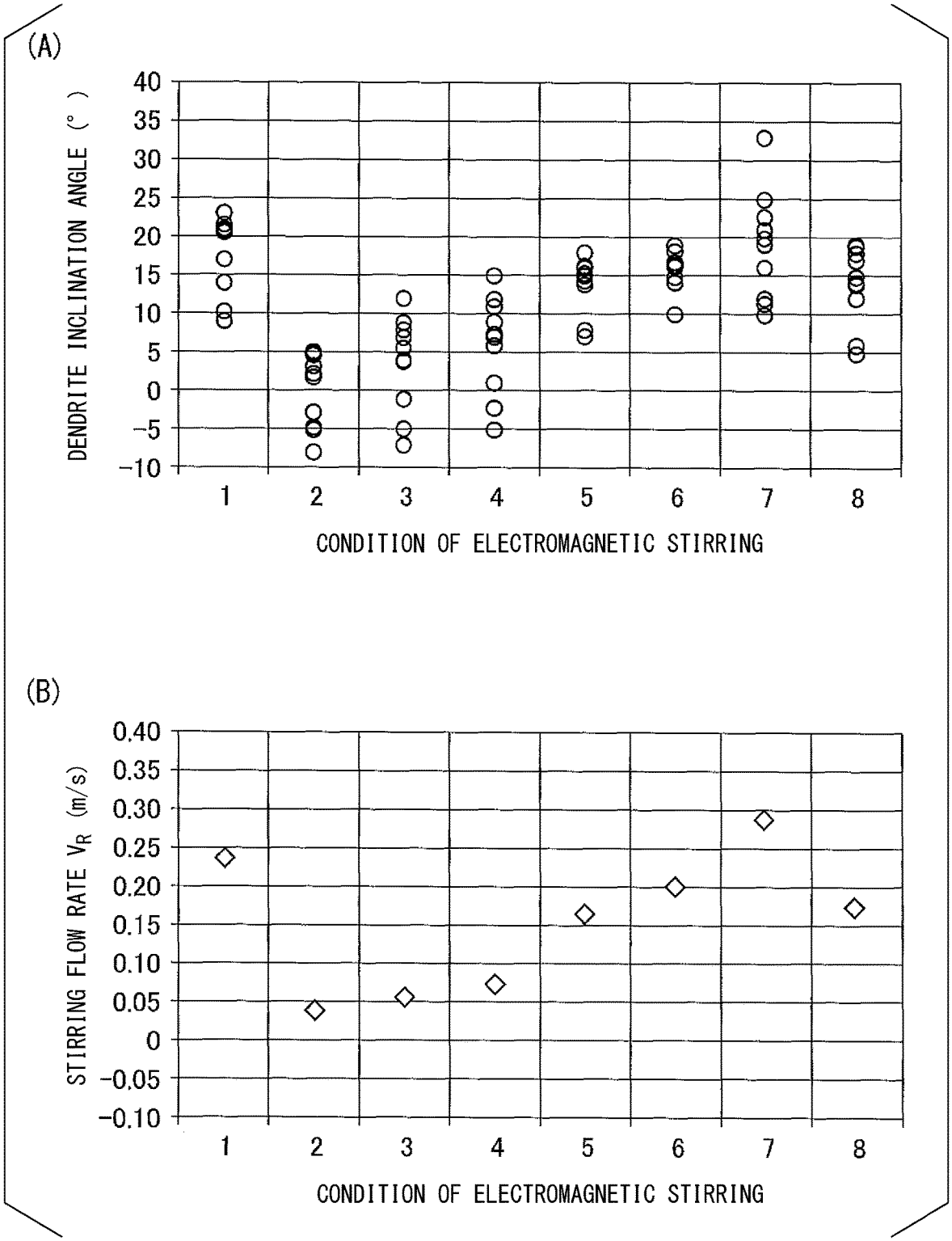
FIG. 13 is a graph showing the effects on the stirring flow rate in a mold with the electromagnetic stirring condition shown by the horizontal axis, wherein the vertical axis in (A) shows the dendrite inclination angle of a slab, and the vertical axis in (B) shows the stirring flow rate determined from the average dendrite inclination angle.

(A) of FIG. 13 shows the results of measuring the dendrite inclination angle at the center in the width direction of the electromagnetic stirring coil (the position of 75 mm below the meniscus) at a shell thickness of 3 mm by changing the coil current of the electromagnetic stirring and setting various conditions from No. 1 to No. 8. It can be seen that under the conditions of Nos. 2, 3, and 4, the dendrite inclination angle fluctuates interposing 0° between the plus and minus sides, and under conditions of Nos. 1, 5, 6, 7, and 8, the dendrite inclination angle is in only one direction although the angle fluctuates. The stirring flow rate $V_R$ in front of the solidified shell was determined using the formula of Okano et al. from the average dendrite inclination angle, and (B) of FIG. 13 shows the results of plotting the stirring flow rate $V_R$. In this experiment, the flow rate U of the counter flow 13 determined by substituting a by 0.1 in Formula (6A) was always 0.15 m/s, and under the conditions of Nos. 1, 5, 6, 7, and 8, the stirring flow rate $V_R$ was equal to or faster than the counter flow rate U. From the above-described results, as for the relationship between the stirring flow rate $V_R$ and the counter flow rate U, it has been found that by satisfying the relationship shown in Formula (8) described below, the formation of the swirling flow in the meniscus portion is stabilized and a preferable result can be obtained.

$$V_R \geq 0.1 \times B\sqrt{((\sigma DV)/\rho)} \quad \text{Formula (8)}$$

Based on the above-described results, the formation of the swirling flow in the meniscus portion has been stabilized if the relationship between the frequency of the alternating current passing through the electromagnetic stirring unit f, the electric conductivity of the mold copper plate $\sigma_{Cu}$, the copper plate thickness on the long side $D_{Cu}$, and the slab thickness T satisfies Formulae (7A) and (7B), and if the stirring flow rate $V_R$ satisfies Formula (8) that shows a condition in which the stirring flow rate $V_R$ is equal to or faster than the counter flow rate U.

The electromagnetic stirring unit 8 to form a stirring flow on the surface of the molten steel in the mold preferably has a core thickness in the casting direction of 100 mm or more. Then, a meniscus portion 14 is in the range from the upper end to the lower end of the core. Since the meniscus portion 14 is generally located at a position of 100 mm from the upper end of the mold, the upper end of the core is required to be at the portion of 100 mm from the upper end of the mold or above the position. The position of the lower end of the core is determined so that the position does not interfere with the DC magnetic field generation unit 5 arranged below the electromagnetic stirring unit 8.

EXAMPLES

Example 1

Low carbon steel was continuously cast using thin-slab continuous casting equipment having a device for controlling a flow in a mold shown in FIG. 1. The mold 1 has a width of 1,200 mm and a thickness of 150 mm, and has a rectangular mold shape. The casting was performed at a casting speed of 3 m/min in the mold. (A) of FIG. 1 is a schematic view of the horizontal section including a mold inner side 15, and (B) of FIG. 1 is a schematic view of the vertical section. As shown in FIG. 2, the immersion nozzle 2 has the discharge hole 3 on each of both the side surfaces in the mold width direction 11 of the immersion nozzle 2, and has the slit 4 (slit thickness: δ) that leads to the bottom of the immersion nozzle 2 and the bottoms of the two discharge holes 3 and opens outside. The shape of the discharge hole 3 on the nozzle side surface was a circle with a slit, and the equivalent diameter of the circle having the same cross-sectional area as the total area of the circle and the slit was defined as the discharge hole diameter d. Here, the nozzle shape was changed and casting was performed.

As shown in FIG. 1, the DC magnetic field generation unit 5 was provided. The core 6 of the DC magnetic field generation unit 5 was arranged so that the center in the height direction is at 300 mm below the molten metal surface level in the mold (meniscus portion 14). As a result, it is possible to apply the DC magnetic field 23 that has a uniform magnetic flux density distribution in the mold width direction 11 and is toward the thickness direction of the slab. The DC magnetic field 23 of 0.8 T at maximum can be applied to the DC magnetic field zone 7 in the molten metal passage space in the mold. The height region in which the core 6 of the DC magnetic field generation unit 5 is present is the DC magnetic field zone 7. Since the core 6 of the DC magnetic field generation unit 5 has a thickness of 200 mm, it is possible to apply the DC magnetic field 23 of 0.8 T at maximum having almost the same magnetic flux density over the range of 200 to 400 mm in the casting direction from the molten metal surface level (meniscus portion 14). The molten metal surface level in the mold is generally located at about 100 mm below the upper end of the mold copper plate.

The position of the immersion nozzle 2 that supplies molten steel in the mold (the distance between the lower end of the immersion nozzle 2 and the lower end of the core 6 L) was changed depending on the conditions, and the results were compared. In the case that the lower end of the immersion nozzle 2 was below the lower end of the core 6, the value of L was shown as a negative value.

Since the casting condition was that the inner diameter of the immersion nozzle D (the inner diameter of the straight pipe toward the vertical direction of the immersion nozzle) was 100 mm, the average flow rate V in the nozzle was 1.16 m/s. In selecting the condition and evaluating the result, the electric conductivity of the molten steel was $\sigma$=650,000 S/m and the density of the molten steel was $\rho$=7,200 kg/m$^3$. Since the casting was thin-slab casting and an Ar gas was not blown into the immersion nozzle, Formula (6) was used in which a in Formula (6A) was substituted by 0.1.

The number of the inclusions in the slab was evaluated based on two kinds of indexes, the defect index on the surface of the slab and the inclusion index inside the slab.

Regarding the defect index on the surface of the slab, a sample of the entire width and a length in the casting direction of 200 mm was cut out from each of the upper surface and the lower surface of the slab. Then, the inclusion in the surface of the entire width and a length of 200 mm was ground off every 1 mm from the surface to a thickness of 20 mm. Then, the number of the inclusions having a size of 100 μm or more was investigated, and the total number was indexed to obtain a defect index. The total number was converted into 10 under the condition in Comparative Example in which the casting was performed under the condition that a nozzle having two holes and having no slit was used and no electromagnetic force was applied (Comparative Example No. 8), a total number under another condition was converted into a ratio to the above-described converted total number 10 and shown as a defect index, and a defect index of 6 or less was required. A defect index of 5 or less was evaluated as good, and a defect index of more than 6 was evaluated as bad.

Regarding the inclusion index inside the slab, samples were cut out from the portions at ¼ of the width to the left and the right and at ½ of the width to the left and the right from the width center at ¼ of the thickness in the upper surface side, and the number of the inclusions was investigated by a slime extraction method. The number was converted into 10 under the condition in which the casting was performed under the condition that a nozzle having two holes and having no slit was used and no electromagnetic force was applied (Comparative Example No. 8), a number under another condition was converted into a ratio to the above-described converted number 10 and shown as an inclusion index, and an inclusion index of 6 or less was required. An inclusion index of 5 or less was evaluated as good, and an inclusion index of more than 6 was evaluated as bad.

In addition, the fluctuation of the molten metal surface level during the casting and the state of the molten metal surface such as the metal plating were also investigated.

The results are shown in Table 1. Numerical values that are out of the range specified for the device for controlling a flow in a mold according to the present disclosure (immersion nozzle condition, magnetic flux density B, core length below nozzle L) are underlined. If Formula (5) specified in the method for controlling a flow in a mold according to the present disclosure is not satisfied, the value of the "required core length $L_C$" is underlined, and if Formula (6) is not satisfied, the value of the "counter flow rate U" is underlined.

Invention Examples No. 6 and 7, the discharge hole diameter was out of the preferable range of the present disclosure. Although the castability was slightly unstable in all the above-described Invention Examples, it was possible to exhibit the effect of the present disclosure.

Comparative Example No. 8 is an example used as a reference to explain the effect of the present disclosure, and the fluctuation of the molten metal surface was large because of the condition that a nozzle having two holes and having no slit was used and no electromagnetic force was applied as described above. Comparative Example 9 is an example in which a nozzle having two holes and having no slit was used in the same manner as in Comparative Example 8 but both the magnetic flux density B and the core length below the nozzle L satisfy the requirements specified in the present disclosure, and the molten metal surface was so unstable that it was impossible to obtain desired evaluation.

In all of Comparative Example 10, Comparative Example 11, and Comparative Example 12, the magnetic flux density is below the lower limit in Formula (1). Therefore, in Comparative Examples 10 and 11, regarding the requirement of the distance from the lower end of the immersion nozzle to the lower end of the core (core length below the nozzle) L, Formula (2) was satisfied, but Formula (5) was

TABLE 1

| | | Immersion nozzle | | DC magnetic field | Position of immersion nozzle | | | Evaluation result | | |
|---|---|---|---|---|---|---|---|---|---|---|
| | No | Discharge hole diameter d (mm) | Slit thickness δ (mm) | Magnetic flux density B (T) | Core length below nozzle L (m) | Required core length LC (m) | Counter flow rate U (m/s) | Defect index | Inclusion index | Castability |
| Invention Example | 1 | 60 | 20 | 0.4 | 0.15 | 0.04 | 0.12 | 3 | 3.5 | No problem |
| | 2 | 60 | 25 | 0.4 | 0.15 | 0.04 | 0.12 | 2.8 | 3 | No problem |
| | 3 | 60 | 30 | 0.4 | 0.15 | 0.04 | 0.12 | 2.6 | 2.8 | No problem |
| | 4 | 60 | 40 | 0.4 | 0.15 | 0.04 | 0.12 | 3.1 | 5.3 | Molten metal surface is slightly unstable |
| | 5 | 60 | 10 | 0.4 | 0.15 | 0.04 | 0.12 | 4.3 | 5.6 | Slit is slightly clogged |
| | 6 | 20 | 25 | 0.4 | 0.15 | 0.04 | 0.12 | 5.2 | 4.8 | Nozzle is sometimes clogged |
| | 7 | 80 | 25 | 0.4 | 0.15 | 0.04 | 0.12 | 6 | 5.9 | Molten metal surface is slightly unstable |
| Comparative Example | 8 | 90 | None | 0 | 0.15 | — | | 10 | 10 | Fluctuation of molten metal surface is large |
| | 9 | 90 | None | 0.4 | 0.15 | 0.04 | 0.12 | 8 | 7.5 | Molten metal surface is unstable |
| | 10 | 65 | 23 | 0.1 | 0.08 | 0.64 | 0.03 | 8 | 9 | Control of nozzle discharge flow is insufficient |
| | 11 | 65 | 23 | 0.2 | 0.08 | 0.16 | 0.06 | 7 | 7 | Control of nozzle discharge flow is insufficient |
| | 12 | 65 | 23 | 0.3 | 0.03 | 0.07 | 0.09 | 6 | 9 | Control of nozzle discharge flow is insufficient |
| Invention Example | 13 | 65 | 23 | 0.4 | 0.1 | 0.04 | 0.12 | 3 | 3 | No problem |
| | 14 | 65 | 23 | 0.5 | 0.1 | 0.03 | 0.15 | 2 | 2 | No problem |
| Comparative Example | 15 | 65 | 23 | 0.4 | 0.25 | 0.04 | | 8 | 4 | Meniscus is unstable |
| | 16 | 65 | 23 | 0.4 | −0.05 | 0.04 | | 9 | 8 | Heat supply to meniscus is insufficient |
| Invention Example | 17 | 65 | 23 | 0.4 | 0.15 | 0.04 | 0.12 | 2.6 | 2.8 | No problem |
| | 18 | 65 | 23 | 0.4 | 0.08 | 0.04 | 0.12 | 3.1 | 3.1 | No problem |
| | 19 | 65 | 23 | 0.35 | 0.06 | 0.05 | 0.11 | 3.5 | 4 | No problem |

All the experimental examples in which the conditions of the present disclosure are satisfied showed good results. In Invention Examples No. 4 and 5, the slit thickness δ was out of the preferable range of the present disclosure, and in not satisfied that shows the requirement for the method for controlling a flow. Regarding the core length below the nozzle in Comparative Example No. 12, neither Formula (2) nor Formula (5) was satisfied. As a result, in all of Comparative Examples 10 to 12, the braking of the nozzle discharge flow was insufficient, and the counter flow rate U was also insufficient.

Under the condition in Comparative Example No. 15, the position of the lower end of the immersion nozzle is above the upper end of the core. Under the condition in Comparative Example No. 16, the position of the lower end of the immersion nozzle is below the lower end of the core. Under these conditions, the discharge hole and the slit were not present in the DC magnetic field zone that is the height region in which the core is present, and as a result, it was impossible to exhibit the effect of the present disclosure under all of the conditions.

Example 2

In addition to the conditions adopted in Example 1 described above, the electromagnetic stirring unit 8 was arranged in the meniscus portion in the mold in which the slab thickness was T=150 mm, and a swirling flow was formed in the molten steel in the mold to form the stirring flow 16 in the meniscus portion, and the effect was confirmed. For this purpose, the mold copper plate material and the mold copper plate thickness $D_{Cu}$ were set in accordance with the conditions shown in Table 2, the current was applied under the conditions that the frequency f of the AC magnetic field applied to the electromagnetic stirring unit was changed as shown in Table 2, and casting was performed. Table 2 shows the right side of Formula (7A) as "mold skin depth" and the left side of Formula (7B) as "molten steel electromagnetic force skin depth".

As the conditions of the immersion nozzle 2 and the DC magnetic field generation unit 5, the conditions in Invention Example 13 shown in Table 1 were adopted. The immersion nozzle inner diameter was D=100 mm, the slit thickness was δ=23 mm, the discharge hole diameter of the nozzle having two holes was d=65 mm, and the magnetic flux density formed by the DC magnetic field generation unit was B=0.4 T. The counter flow rate calculated by substituting a by 0.1 in Formula (6A) was U=0.12 m/s.

The C-section solidified structure of the slab cast under the above-described conditions was sampled, the dendrite inclination angle was measured at the center of the width at a shell thickness of 3 mm, and the stirring flow rate $V_R$ was estimated from the inclination angle using the formula of Okano et al. The results are shown in Table 2.

Regarding the defect index on the surface of the slab, a sample of the entire width and a length in the casting direction of 200 mm was cut out from each of the upper surface and the lower surface of the slab, the inclusion in the surface of the entire width and a length of 200 mm was ground off every 1 mm from the surface to a thickness of 20 mm, the number of the inclusions having a size of 100 μm or more was investigated, and the total number was indexed to obtain a defect index. The total number was converted into 10 under the condition in which the casting was performed under the condition that a nozzle having two holes was used and no electromagnetic force was applied (Comparative Example No. 8 in Table 1), and a total number under another condition was converted into a ratio to the above-described converted total number 10 and shown as a defect index. An inclusion index of 5 or less was evaluated as good, and an inclusion index of more than 5 was evaluated as bad.

Regarding the inclusion index inside the slab, samples were cut out from the portions at ¼ of the width to the left and the right and at ½ of the width to the left and the right from the width center at ¼ of the thickness in the upper surface side, and the number of the inclusions was investigated by a slime extraction method. The number was converted into 10 under the condition in which the casting was performed under the condition that a nozzle having two holes was used and no electromagnetic force was applied (Comparative Example No. 8 in Table 1), and a number under another condition was converted into a ratio to the above-described converted number 10 and shown as an inclusion index. An inclusion index of 5 or less was evaluated as good, and an inclusion index of more than 5 was evaluated as bad. In addition, the fluctuation of the molten metal surface level during the casting and the state of the flow were also investigated.

Under the condition in Invention Example No. A0 shown in Table 2, in-mold electromagnetic stirring is not performed, and Invention Example No. A0 corresponds to Invention Example No. 13 in Table 1.

TABLE 2

| | | Condition of mold | | Condition of electromagnetic stirring | | | | Slab quality | |
|---|---|---|---|---|---|---|---|---|---|
| | No. | Mold material | Mold thickness $D_{cu}$ (m) | Frequency f (Hz) | Mold skin depth (m) right side of Formula (7A) | Molten steel electromagnetic force skin depth (m) left side of Formula (7B) | State of stirring: Stirring flow rate $V_R$ (m/s) | Defect index | Inclusion index |
| Invention Example | A1 | ES40A | 0.03 | 4 | 0.058 | 0.156 | 0.12 | 1.6 | 3.3 |
| | A2 | ES40A | 0.03 | 10 | 0.037 | 0.099 | 0.20 | 1.6 | 2.9 |
| | A3 | ES40A | 0.03 | 16 | 0.029 | 0.078 | 0.18 | 1.9 | 3.2 |
| | A4 | ES40A | 0.04 | 20 | 0.026 | 0.070 | 0.10 | 2 | 2.8 |
| | A5 | ES40A | 0.04 | 2 | 0.082 | 0.221 | 0.05 | 2.6 | 3 |
| | A0 | ES40A | 0.04 | — | — | — | 0 | 3 | 3 |

As a result, it was possible to obtain a good result in all of Invention Examples No. A1 to A5 in which in-mold electromagnetic stirring was performed. Among Invention Examples, the best results of the defect index and the inclusion index were obtained in Invention Example No. A2 in which the frequency f was set so that the mold skin depth (the right side of Formula (7A)) was larger than the mold copper plate thickness $D_{Cu}$ and the molten steel electromagnetic force skin depth (the left side of Formula (7B)) was smaller than the slab thickness T=0.15 m, and the stirring flow rate $V_R$ was set to be larger than the counter flow rate U to form a swirling flow efficiently at the molten metal surface level.

As described above, even in thin-slab casting, by making the immersion nozzle discharge flow have the highest braking efficiency, the nozzle discharge flow can be braked and uniformly dispersed, and the meniscus can be supplied with heat. Furthermore, by applying a swirling flow in the vicinity of the meniscus, the swirling flow can be applied without stagnation in the center of the width. As a result, a slab excellent in both the surface and the inner quality can be cast. That is, the flow in the mold can be stably controlled under the condition of high throughput, and the productivity of the thin-slab casting process is dramatically improved.

FIELD OF INDUSTRIAL APPLICATION

According to the present disclosure, a slab excellent in both the surface and the inner quality can be cast.

BRIEF DESCRIPTION OF THE REFERENCE SYMBOLS

1 Mold
2 Immersion nozzle
3 Discharge hole
4 Slit
5 DC magnetic field generation unit
6 Core
7 DC magnetic field zone
8 Electromagnetic stirring unit
11 Mold width direction
12 Discharge flow
13 Counter flow
14 Meniscus portion
15 Mold inner side
16 Stirring flow
17 Mold long side wall
21 Conductor
22 Refractory
23 DC magnetic field
24 Molten steel flow
25 Induced electromotive force
26 Induced current
27 Braking force
28 Return path
29 Plug flow

What is claimed is:

1. A device for controlling a flow in a mold comprising:

a DC magnetic field generation unit having a core that applies a DC magnetic field toward a mold thickness direction in an entire width in a mold width direction; and an immersion nozzle having a discharge hole formed on each of both side surfaces in the mold width direction, and having a slit formed at a bottom so that the slit leads to a bottom of each discharge hole and opens outside, the device having a thickness on a short side of a meniscus portion of 150 mm or less and a casting width of 2 m or less, the device used in thin-slab casting of steel, wherein the discharge hole and the slit are present in a DC magnetic field zone that is a height region in which the core of the DC magnetic field generation unit is present, and a magnetic flux density B (T) in the DC magnetic field zone and a distance L (m) from a lower end of the immersion nozzle to a lower end of the core satisfy Formula (1) and Formula (2) described below:

$$0.35T \leq B \leq 1.0T \quad \text{Formula (1)}$$

$$L \geq 0.06 \text{ m} \quad \text{Formula (2), and}$$

wherein a discharge hold diamter d (mm) of the discharge hole, the discharge hole diameter corresponding to a diameter of a circle having the same cross-sectional area as a total cross-sectional area of an opening on the side surface of the immersion nozzle, a slit thickness δ (mm) of the slit, and an inner diameter D (mm) of the immersion nozzle satisfy Formula (3) and Formula (4) described below;

$$D/8 \leq \delta \leq D/3 \quad \text{Formula (3)}$$

$$\delta \leq d \leq 2/3 \times D \quad \text{Formula (4).}$$

2. The device for controlling a flow in a mold according to claim 1, wherein the discharge hole is formed so that a discharge flow is perpendicular to an axis direction of the immersion nozzle.

3. The device for controlling a flow in a mold according to claim 1, further comprising an electromagnetic stirring unit that is configured to apply a swirling flow on a surface of molten steel in the mold.

4. The device for controlling a flow in a mold according to claim 3, wherein a thickness $D_{Cu}$ (mm) of a copper plate forming a long side wall of the mold, a thickness T (mm) of a slab, a frequency f (Hz) of the electromagnetic stirring unit, and an electric conductivity $\sigma_{Cu}$ (S/m) of the copper plate are adjusted to satisfy Formula (7A) and Formula (7B) described below:

$$D_{Cu} < \sqrt{(2/(\sigma_{Cu}\omega\mu))} \quad \text{Formula (7A)}$$

$$\sqrt{(1/(2\sigma\omega\mu))} < T \quad \text{Formula (7B)}$$

wherein ω represents an angular velocity (rad/sec) of 2πf, μ represents a magnetic permeability ($N/A^2$) of a vacuum of $4\pi \times 10^{-7}$, and σ represents an electric conductivity (S/m) of the molten steel.

5. A method for controlling a flow in a mold, the method using a device for controlling a flow in a mold comprising:

a DC magnetic field generation unit having a core that applies a DC magnetic field toward a mold thickness direction in an entire width in a mold width direction; and an immersion nozzle having a discharge hole formed on each of both side surfaces in the mold width direction, and having a slit formed at a bottom so that the slit leads to a bottom of each discharge hole and opens outside, the device having a thickness on a short side of a meniscus portion of 150 mm or less and a casting width of 2 m or less, the device used in thin-slab casting of steel, wherein the discharge hole and the slit are present in a DC magnetic field zone that is a height region in which the core of the DC magnetic field generation unit is present, and a magnetic flux density B (T) in the DC magnetic field zone and a distance L (m) from a lower end of the immersion nozzle to a lower end of the core satisfy Formula (1) and Formula (2) described below:

$$0.35T \leq B \leq 1.0T \quad \text{Formula (1)}$$

$$L \geq 0.06 \text{ m} \quad \text{Formula (2)}$$

the method used in thin-slab casting of steel, wherein a magnetic flux density B (T) of a DC magnetic field to be applied and the distance L (m) from the lower end of the immersion nozzle to the lower end of the core satisfy Formula (5) and Formula (6) described below with respect to an average flow rate V (m/s) in the immersion nozzle:

$$L \geq L_C = (\rho V)/(2\sigma B^2) \quad \text{Formula (5)}$$

$$0.1 \times B\sqrt{((\sigma DV)/\rho)} \geq 0.1 \text{ (m/s)} \quad \text{Formula (6)}$$

wherein D represents the inner diameter (m) of the immersion nozzle, ρ represents a density (kg/m$^3$) of a molten metal, and σ represents an electric conductivity (S/m) of the molten metal.

6. A method for controlling a flow in a mold, the method using a device for controlling a flow in a mold comprising:

a DC magnetic field generation unit having a core that applies a DC magnetic field toward a mold thickness direction in an entire width in a mold width direction; and an immersion nozzle having a discharge hole formed on each of both side surfaces in the mold width direction, and having a slit formed at a bottom so that the slit leads to a bottom of each discharge hole and opens outside, the device having a thickness on a short side of a meniscus portion of 150 mm or less and a casting width of 2 m or less, the device used in thin-slab casting of steel, wherein the discharge hole and the slit are present in a DC magnetic field zone that is a height region in which the core of the DC magnetic field generation unit is present, and a magnetic flux density B (T) in the DC magnetic field zone and a distance L (m) from a lower end of the immersion nozzle to a lower end of the core satisfy Formula (1) and Formula (2) described below:

$$0.35T \leq B \leq 1.0T \quad \text{Formula (1)}$$

$$L \geq 0.06 \text{ m} \quad \text{Formula (2),}$$

further comprising:

an electromagnetic stirring unit that is configured to apply a swirling flow on a surface of molten steel in the mold, the method used in thin-slab casting of steel, wherein a magnetic flux density B (T) of a DC magnetic field to be applied and the distance L (m) from the lower end of the immersion nozzle to the lower end of the core satisfy Formula (5) and Formula (6) described below with respect to an average flow rate V (m/s) in the immersion nozzle:

$$L \geq L_C = (\rho V)/(2\sigma B^2) \quad \text{Formula (5)}$$

$$0.1 \times B\sqrt{((\sigma DV)/\rho)} \geq 0.1 \text{ (m/s)} \quad \text{Formula (6)}$$

wherein D represents the inner diameter (m) of the immersion nozzle, ρ represents a density (kg/m$^3$) of a molten metal, and σ represents an electric conductivity (S/m) of the molten metal.

7. The method for controlling a flow in a mold according to claim 6, the method used in thin-slab casting of steel, wherein the thickness $D_{Cu}$ (mm) of the copper plate on a long side of the mold, the thickness T (mm) of the slab, the frequency f (Hz) of the electromagnetic stirring unit, and the electric conductivity $\sigma_{Cu}$ (S/m) of the copper plate are adjusted to satisfy Formula (7A) and Formula (7B) described below:

$$D_{Cu} < \sqrt{(2/(\sigma_{Cu}\omega\mu))} \quad \text{Formula (7A)}$$

$$\sqrt{(1/(2\sigma\omega\mu))} < T \quad \text{Formula (7B)}$$

wherein ω represents the angular velocity (rad/sec) of 2πf, μ represents the magnetic permeability (N/A$^2$) of a vacuum of $4\pi \times 10^{-7}$, and σ represents the electric conductivity (S/m) of the molten steel.

8. The method for controlling a flow in a mold according to claim 7, the method used in thin-slab casting of steel, wherein a stirring flow rate $V_R$ (m/s) of the molten steel on the surface of the molten steel in the mold satisfies Formula (8) described below:

$$V_R \geq 0.1 \times B\sqrt{((\sigma DV)/\rho)} \quad \text{Formula (8)}$$

wherein the stirring flow rate $V_R$ (m/s) of the molten steel is determined based on a dendrite inclination angle in a cross section of the slab.

9. A device for controlling a flow in a mold comprising:

a DC magnetic field generation unit having a core that applies a DC magnetic field toward a mold thickness direction in an entire width in a mold width direction;

an immersion nozzle having a discharge hole formed on each of both side surfaces in the mold width direction, and having a slit formed at a bottom so that the slit leads to a bottom of each discharge hole and opens outside; and an electromagnetic stirring unit that is configured to apply a swirling flow on a surface of molten steel in the mold, the device having a thickness on a short side of a meniscus portion of 150 mm or less and a casting width of 2 m or less, the device used in thin-slab casting of steel, wherein the discharge hole and the slit are present in a DC magnetic field zone that is a height region in which the core of the DC magnetic field generation unit is present, and a magnetic flux density B (T) in the DC magnetic field zone and a distance L (m) from a lower end of the immersion nozzle to a lower end of the core satisfy Formula (1) and Formula (2) described below:

$$0.35T \leq B \leq 1.0T \quad \text{Formula (1)}$$

$$L \geq 0.06 \text{ m} \quad \text{Formula (2).}$$

wherein a thickness $D_{cu}$ (mm) of a copper plate forming a long side wall of the mold, a thickness T (mm) of a slab, a frequency f (Hz) of the electromagnetic stirring unit, and an electric conductivity $\sigma_{cu}$ (S/m) of the copper plate are adjusted to satisfy Formula (7A) and Formula (7B) described below:

$$D_{Cu} < \sqrt{(2/(\sigma_{Cu}\omega\mu))} \quad \text{Formula (7A)}$$

$$\sqrt{(1/(2\sigma\omega\mu))} < T \quad \text{Formula (7B)}$$

wherein ω represents an angular velocity (rad/sec) of 2πf, μ represents a magnetic permeability (N/A$^2$) of a vacuum of $4\pi \times 10^{-7}$, and a represents an electric conductivity (S/m) of the molten steel.

10. The device for controlling a flow in a mold according to claim 9, wherein the discharge hole is formed so that a discharge flow is perpendicular to an axis direction of the immersion nozzle.

* * * * *